US009725195B2

(12) United States Patent
Lancaster, III et al.

(10) Patent No.: US 9,725,195 B2
(45) Date of Patent: Aug. 8, 2017

(54) ELECTRONIC CONTROL OF METERED FILM DISPENSING IN A WRAPPING APPARATUS

(75) Inventors: Patrick R. Lancaster, III, Louisville, KY (US); Robert D. Janes, Sr., Louisville, KY (US); Michael Mitchell, Louisville, KY (US); Thomas Harris, Louisville, KY (US); Richard L. Johnson, La Grange, KY (US)

(73) Assignee: Lantech.com, LLC, Louisville, KY (US)

( * ) Notice: Subject to any disclaimer, the term of this patent is extended or adjusted under 35 U.S.C. 154(b) by 1512 days.

(21) Appl. No.: 12/349,929

(22) Filed: Jan. 7, 2009

(65) Prior Publication Data

US 2009/0178374 A1 Jul. 16, 2009

Related U.S. Application Data

(60) Provisional application No. 61/006,338, filed on Jan. 7, 2008.

(51) Int. Cl.

| | |
|---|---|
| ***B65B 11/02*** | (2006.01) |
| ***B65B 11/04*** | (2006.01) |
| *B65B 11/00* | (2006.01) |

(52) U.S. Cl.

CPC ..... *B65B 11/025* (2013.01); *B65B 11/045* (2013.01); *B65B 2011/002* (2013.01); *B65B 2210/18* (2013.01); *B65B 2210/20* (2013.01)

(58) Field of Classification Search

USPC ..... 53/399, 443, 461, 465, 52, 55, 504, 509, 53/64, 66, 118, 580, 582, 587, 588, 589, 53/591, 203, 211

See application file for complete search history.

(56) References Cited

U.S. PATENT DOCUMENTS

| | | | |
|---|---|---|---|
| 2,227,398 | A | 12/1940 | Mohl |
| 3,029,571 | A | 4/1962 | Douthit |

(Continued)

FOREIGN PATENT DOCUMENTS

| | | |
|---|---|---|
| DE | 3140972 | 6/1982 |
| DE | 3119038 | 12/1982 |

(Continued)

OTHER PUBLICATIONS

"The Technology Behind a 'No-Tear', 'No-Rip' Film Carriage, and How to Explain it to Your Customers," Jan. 21, 2010, downloaded from http://wulftecstretchwrapper.blogspot.com/2010_01_01_archive.html on Jan. 7, 2011 (4 pages).

(Continued)

*Primary Examiner* — Christopher Harmon

(74) *Attorney, Agent, or Firm* — Middleton Reutlinger

(57) ABSTRACT

An apparatus for wrapping a load may include a film dispenser for dispensing a film web including a film dispensing drive. The apparatus may also include a rotational drive system for providing relative rotation between the load and the dispenser during a wrapping cycle. The apparatus may further include a controller configured to operatively couple the film dispensing drive and the rotational drive system such that, for any portion of a revolution of the film dispenser relative to the load during the wrapping cycle, the film dispenser dispenses a selected length of the film web corresponding to the portion of the revolution.

86 Claims, 5 Drawing Sheets

(56) References Cited

U.S. PATENT DOCUMENTS

| | | | |
|---|---|---|---|
| 3,815,313 | A | 6/1974 | Heisler |
| 3,910,005 | A | 10/1975 | Thimon et al. |
| 4,152,879 | A | 5/1979 | Shulman |
| 4,216,640 | A | 8/1980 | Kaufman |
| 4,235,062 | A | 11/1980 | Lancaster et al. |
| 4,271,657 | A | 6/1981 | Lancaster et al. |
| 4,300,326 | A | 11/1981 | Stackhouse |
| 4,387,548 | A | 6/1983 | Lancaster et al. |
| 4,395,255 | A | 7/1983 | Branecky et al. |
| 4,418,510 | A | 12/1983 | Lancaster, III et al. |
| 4,429,514 | A | 2/1984 | Lancaster, III et al. |
| 4,432,185 | A | 2/1984 | Geisinger |
| 4,458,467 | A | 7/1984 | Shulman et al. |
| 4,497,159 | A | 2/1985 | Lancaster, III |
| 4,501,105 | A | 2/1985 | Rogers et al. |
| 4,503,658 | A | 3/1985 | Mouser et al. |
| 4,505,092 | A | 3/1985 | Bowers et al. |
| 4,514,955 | A | 5/1985 | Mouser et al. |
| 4,524,568 | A | 6/1985 | Lancaster et al. |
| 4,590,746 | A | 5/1986 | Humphrey |
| 4,628,667 | A | 12/1986 | Humphrey et al. |
| 4,676,048 | A | 6/1987 | Lancaster et al. |
| 4,693,049 | A | 9/1987 | Humphrey |
| 4,712,354 | A | 12/1987 | Lancaster et al. |
| 4,716,709 | A | 1/1988 | Lamb et al. |
| 4,736,567 | A | 4/1988 | Pienta |
| 4,754,594 | A | 7/1988 | Lancaster |
| 4,761,934 | A | 8/1988 | Lancaster |
| 4,807,427 | A | 2/1989 | Casteel et al. |
| 4,840,006 | A | 6/1989 | Humphrey |
| 4,845,920 | A | 7/1989 | Lancaster |
| 4,855,924 | A | 8/1989 | Strosser et al. |
| 4,862,678 | A | 9/1989 | Humphrey |
| 4,866,909 | A | 9/1989 | Lancaster, III et al. |
| 4,905,451 | A | 3/1990 | Jaconelli |
| 4,953,336 | A | 9/1990 | Lancaster, III et al. |
| 4,991,381 | A | 2/1991 | Simons |
| 5,027,579 | A | 7/1991 | Keip |
| 5,040,356 | A | 8/1991 | Thimon |
| 5,040,359 | A | 8/1991 | Thimon |
| 5,054,263 | A | 10/1991 | Maki-Rahkola et al. |
| 5,077,956 | A | 1/1992 | Thimon |
| 5,081,824 | A | 1/1992 | Thimon et al. |
| 5,107,657 | A | 4/1992 | Diehl et al. |
| 5,123,230 | A | 6/1992 | Upmann |
| 5,138,817 | A | 8/1992 | Mowry et al. |
| 5,163,264 | A | 11/1992 | Hannen |
| 5,186,981 | A | 2/1993 | Shellhamer et al. |
| 5,195,296 | A | 3/1993 | Matsumoto |
| 5,195,297 | A | 3/1993 | Lancaster et al. |
| 5,195,301 | A | 3/1993 | Martin-Cocher et al. |
| 5,203,136 | A | 4/1993 | Thimon et al. |
| 5,203,139 | A | 4/1993 | Salsburg et al. |
| 5,216,871 | A | 6/1993 | Hannen |
| 5,240,198 | A | 8/1993 | Dorfel |
| 5,301,493 | A | 4/1994 | Chen |
| 5,311,725 | A | 5/1994 | Martin et al. |
| 5,315,809 | A | 5/1994 | Gordon et al. |
| 5,369,416 | A | 11/1994 | Haverty et al. |
| 5,414,979 | A | 5/1995 | Moore et al. |
| 5,447,008 | A | 9/1995 | Martin-Cocher |
| 5,450,711 | A | 9/1995 | Martin-Cocher |
| 5,463,842 | A | 11/1995 | Lancaster |
| 5,572,855 | A | 11/1996 | Reigrut |
| 5,581,979 | A | 12/1996 | Scherer |
| 5,595,042 | A | 1/1997 | Cappi et al. |
| 5,634,321 | A | 6/1997 | Martin-Cocher et al. |
| 5,653,093 | A | 8/1997 | Delledonne |
| 5,671,593 | A | 9/1997 | Ginestra et al. |
| 5,765,344 | A | 6/1998 | Mandeville et al. |
| 5,768,862 | A | 6/1998 | Mauro et al. |
| 5,797,246 | A | 8/1998 | Martin-Cocher |
| 5,799,471 | A | 9/1998 | Chen |
| 5,836,140 | A | 11/1998 | Lancaster, III |
| 5,875,617 | A | 3/1999 | Scherer |
| 5,884,453 | A | 3/1999 | Ramsey et al. |
| 5,953,888 | A | 9/1999 | Martin-Cocher et al. |
| 6,082,081 | A | 7/2000 | Mucha |
| 6,185,900 | B1 | 2/2001 | Martin |
| 6,195,968 | B1 | 3/2001 | Marois et al. |
| 6,253,532 | B1 | 7/2001 | Orpen |
| 6,293,074 | B1 | 9/2001 | Lancaster et al. |
| 6,360,512 | B1 | 3/2002 | Marois et al. |
| 6,370,839 | B1 | 4/2002 | Nakagawa et al. |
| 6,453,643 | B1 | 9/2002 | Buscherini et al. |
| 6,516,591 | B1 | 2/2003 | Lancaster, III et al. |
| 6,684,612 | B2 | 2/2004 | Trottet |
| 6,698,161 | B1 | 3/2004 | Rossi |
| 6,748,718 | B2 | 6/2004 | Lancaster, III et al. |
| 6,826,893 | B2 | 12/2004 | Cere' |
| 6,848,240 | B2 | 2/2005 | Frey |
| 6,851,252 | B2 | 2/2005 | Mäki-Rahkola et al. |
| 6,918,229 | B2 | 7/2005 | Lancaster, III et al. |
| 7,386,968 | B2 | 6/2008 | Sperry et al. |
| 7,490,823 | B2 | 2/2009 | Oishi et al. |
| 7,540,128 | B2 | 6/2009 | Lancaster, III et al. |
| 7,568,327 | B2 | 8/2009 | Lancaster, III et al. |
| 7,707,801 | B2 | 5/2010 | Lancaster, III |
| 7,707,901 | B2 | 5/2010 | Lancaster et al. |
| 7,779,607 | B2 | 8/2010 | Lancaster, III et al. |
| 8,001,745 | B2 | 8/2011 | Carter et al. |
| 8,037,660 | B2 | 10/2011 | Lancaster, III et al. |
| 8,074,431 | B1 | 12/2011 | Pierson et al. |
| 8,276,346 | B2 | 10/2012 | Lancaster, III et al. |
| 8,276,354 | B2 | 10/2012 | Lancaster, III et al. |
| 8,739,502 | B2 | 6/2014 | Lancaster, III et al. |
| 2001/0015057 | A1 | 8/2001 | Suolahti |
| 2003/0089081 | A1 | 5/2003 | Platon |
| 2003/0110737 | A1 | 6/2003 | Lancaster, III et al. |
| 2003/0145563 | A1 | 8/2003 | Cere' |
| 2003/0200731 | A1 | 10/2003 | Maki-Rahkola et al. |
| 2003/0200732 | A1 | 10/2003 | Maki-Rahkola et al. |
| 2004/0031238 | A1 | 2/2004 | Cox |
| 2005/0044812 | A1 | 3/2005 | Lancaster, III et al. |
| 2005/0115202 | A1 | 6/2005 | Mertz, II et al. |
| 2006/0028969 | A1 | 2/2006 | Kondo et al. |
| 2006/0213155 | A1 | 9/2006 | Forni et al. |
| 2006/0248858 | A1 | 11/2006 | Lancaster, III et al. |
| 2006/0254214 | A1 | 11/2006 | Cox et al. |
| 2006/0254225 | A1 | 11/2006 | Lancaster, III et al. |
| 2006/0289691 | A1 | 12/2006 | Forni |
| 2007/0204564 | A1 | 9/2007 | Lancaster, III et al. |
| 2007/0204565 | A1 | 9/2007 | Lancaster, III et al. |
| 2007/0209324 | A1 | 9/2007 | Lancaster, III et al. |
| 2008/0229714 | A1 | 9/2008 | Zitella et al. |
| 2008/0295614 | A1 | 12/2008 | Lancaster, III et al. |
| 2009/0178374 | A1 | 7/2009 | Lancaster, III et al. |
| 2009/0293425 | A1 | 12/2009 | Carter et al. |
| 2010/0107653 | A1 | 5/2010 | Paskevich et al. |
| 2010/0239403 | A1 | 9/2010 | Lancaster, III et al. |
| 2010/0300049 | A1 | 12/2010 | Schmidt et al. |
| 2010/0303526 | A1 | 12/2010 | Hayase |
| 2010/0320305 | A1 | 12/2010 | Lia |
| 2011/0131927 | A1 | 6/2011 | Lancaster, III et al. |
| 2011/0146203 | A1 | 6/2011 | Lancaster, III et al. |
| 2011/0168751 | A1 | 7/2011 | Tsurumi |
| 2011/0179752 | A1 | 7/2011 | Lancaster, III et al. |
| 2012/0031053 | A1 | 2/2012 | Lancaster, III et al. |
| 2012/0102887 | A1 | 5/2012 | Lancaster, III et al. |
| 2012/0124944 | A1 | 5/2012 | Lancaster, III et al. |
| 2012/0181368 | A1 | 7/2012 | Ekola |
| 2013/0076753 | A1 | 3/2013 | Lancaster, III et al. |
| 2014/0116006 | A1 | 5/2014 | Lancaster, III et al. |
| 2014/0116007 | A1 | 5/2014 | Lancaster, III et al. |
| 2014/0116008 | A1 | 5/2014 | Lancaster, III et al. |

FOREIGN PATENT DOCUMENTS

| | | |
|---|---|---|
| DE | 36 34 924 A1 | 4/1988 |
| DE | 3901704 | 8/1990 |
| DE | 42 34 604 A1 | 4/1994 |
| DE | 19509649 | 9/1996 |
| EP | 0144266 | 6/1985 |
| EP | 0 096 635 B1 | 12/1986 |

(56) References Cited

FOREIGN PATENT DOCUMENTS

| | | | |
|---|---|---|---|
| EP | 0246659 | | 11/1987 |
| EP | 0 466 980 | A1 | 1/1992 |
| EP | 0653352 | | 5/1995 |
| EP | 0671324 | | 9/1995 |
| EP | 0 811 554 | A1 | 10/1997 |
| EP | 1125841 | | 8/2001 |
| EP | 1 213 223 | A1 | 6/2002 |
| EP | 1 705 119 | A1 | 9/2006 |
| EP | 1 717 149 | A1 | 11/2006 |
| EP | 1 736 426 | A2 | 12/2006 |
| EP | 1 736 426 | A3 | 10/2007 |
| GB | 1546523 | | 5/1979 |
| GB | 2059906 | | 4/1981 |
| GB | 2 107 668 | A | 5/1983 |
| JP | 57166252 | | 10/1982 |
| JP | 63191707 | | 8/1988 |
| JP | 0385209 | | 4/1991 |
| JP | 06239311 | | 8/1994 |
| JP | 085448 | | 1/1996 |
| JP | 09254913 | | 9/1997 |
| JP | 11165705 | | 6/1999 |
| JP | 2001048111 | | 2/2001 |
| JP | 2001072012 | | 3/2001 |
| JP | 2002211503 | | 7/2002 |
| JP | 2004161344 | | 6/2004 |
| JP | 3634993 | | 1/2005 |
| JP | 4350940 | | 10/2009 |
| WO | 9107341 | | 5/1991 |
| WO | WO 94/20367 | A1 | 9/1994 |
| WO | WO 97/00202 | A1 | 1/1997 |
| WO | WO 98/22346 | A1 | 5/1998 |
| WO | WO 2004/069659 | A1 | 8/2004 |
| WO | WO 2006/110596 | A1 | 10/2006 |
| WO | WO 2007/071593 | A1 | 6/2007 |
| WO | 2007100596 | | 9/2007 |
| WO | WO 2007/100597 | A2 | 9/2007 |
| WO | WO 2008/007189 | A2 | 1/2008 |
| WO | WO 2008/129432 | A1 | 10/2008 |
| WO | 2012058549 | | 5/2012 |

OTHER PUBLICATIONS

Non-Final Office Action mailed Oct. 28, 2009 in U.S. Appl. No. 11/709,872.

Non-Final Office Action mailed Mar. 20, 2009 in U.S. Appl. No. 11/709,871.

Non-Final Office Action mailed Sep. 17, 2009 in U.S. Appl. No. 11/398,760.

Notice of Allowance mailed Jan. 19, 2010 in U.S. Appl. No. 11/398,760.

Notice of Allowability from U.S. Appl. No. 11/709,871 (now U.S. Pat. No. 7,779,607), mailed Apr. 16, 2010.

Non-Final Office Action mailed Dec. 29, 2008 in U.S. Appl. No. 11/709,872.

PCT International Search Report and Written Opinion for PCT/US2006/013178, mailed Aug. 14, 2006.

International Search Report for PCT/US2004/000219, dated Jun. 21, 2004.

International Search Report and Written opinion for PCT/US2007/004589, dated Sep. 10, 2007.

International Search Report for PCT/US2007/004588, dated Aug. 27, 2007.

International Search Report for PCT/US2007/004581, dated Feb. 5, 2008.

International Search Report and Written Opinion in PCT/US2009/030327, mailed Jun. 22, 2009.

European Patent Office; European Search Report in EP Application No. 15185166.4 dated Jan. 18, 2016; 7 pages.

European Patent Office; European Search Report in EP Application No. 15185183.9 dated Feb. 2, 2016; 6 pages.

Canadian Patent Office; Office Action in Canadian Patent Application No. 2,711,566 dated Mar. 6, 2015; 4 pages.

ELECTRONIC CONTROL OF METERED FILM DISPENSING IN A WRAPPING APPARATUS

This application claims priority under 35 U.S.C. §119 based on U.S. Provisional Application No. 61/006,338, filed Jan. 7, 2008, the complete disclosure of which is incorporated herein by reference.

FIELD

The present disclosure relates to an apparatus and a method for wrapping a load with packaging material, and more particularly, to stretch wrapping a load.

BACKGROUND

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Pallet stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

Wrapping machines provide relative rotation between a packaging material dispenser and a load either by driving the packaging material dispenser around a stationary load or rotating the load on a turntable. Upon relative rotation, packaging material is wrapped on the load. Rotating ring style wrappers generally include a roll of packaging material mounted in a dispenser, which rotates about the load on a rotating ring. Wrapping rotating rings are categorized as vertical rotating rings or horizontal rotating rings. Vertical rotating rings move vertically between an upper and lower position to wrap packaging material around a load. In a vertical rotating ring, as in turntable and rotating wrap arm apparatuses, the four vertical sides of the load are wrapped, along the height of the load. Horizontal rotating rings are stationary and the load moves through the rotating ring, usually on a conveyor, as the packaging material dispenser rotates around the load to wrap packaging material around the load. In the horizontal rotating ring, the length of the load is wrapped. As the load moves through the rotating ring and off the conveyor, the packaging material slides off the conveyor (surface supporting the load) and into contact with the load.

Historically, rotating ring style wrappers have suffered from excessive packaging material breaks and limitations on the amount of wrap force applied to the load (as determined in part by the amount of pre-stretch used) due to erratic speed changes required to wrap "non-square" loads, such as narrow, tall loads, short, wide loads, and short, narrow loads. The non-square shape of such loads often results in the supply of excess packaging material during the wrapping cycle, during time periods in which the demand rate for packaging material by the load is exceeded by the supply rate of the packaging material by the packaging material dispenser. This leads to loosely wrapped loads. In addition, when the demand rate for packaging material by the load is greater than the supply rate of the packaging material by the packaging material dispenser, breakage of the packaging material may occur.

When wrapping a typical rectangular load, the demand for packaging material varies, decreasing as the packaging material approaches contact with a corner of the load and increasing after contact with the corner of the load. When wrapping a tall, narrow load or a short load, the variation in the demand rate is even greater than in a typical rectangular load. In vertical rotating rings, high speed rotating arms, and turntable apparatuses, the variation is caused by a difference between the length and the width of the load. In a horizontal rotating ring apparatus, the variation is caused by a difference between the height of the load (distance above the conveyor) and the width of the load.

The amount of force, or pull, that the packaging material exhibits on the load determines how tightly and securely the load is wrapped. Conventionally, this force is controlled by controlling the feed or supply rate of the packaging material dispensed by the packaging material dispenser with respect to the demand rate of packaging material required by the load. Efforts have been made to supply the packaging material at a constant tension or at a supply rate that increases as the demand rate increases and decreases as the demand rate decreases. However, when variations in the demand rate are large, fluctuations between the feed and demand rates result in loose packaging of the load or breakage of the packaging material during wrapping.

The wrap force of many known commercially available pallet stretch wrapping machines is controlled by sensing changes in demand and attempting to alter the supply of packaging material such that relative constant packaging material wrap force is maintained. With the invention of powered pre-stretching devices, sensing force and speed changes was recognized to be important. This has been accomplished using feedback mechanisms typically linked to or spring loaded dancer bars and electronic load cells. The changing force on the packaging material caused by rotating a rectangular shaped load is transmitted back through the packaging material to some type of sensing device which attempts to vary the speed of the motor driven dispenser to minimize the force change on the packaging material incurred by the changing packaging material demand. The passage of the corner causes the force on the packaging material to increase. This increase in force is typically transmitted back to an electronic load cell, spring-loaded dancer interconnected with a sensing means, or by speed change to a torque control device. After the corner is passed the force on the packaging material reduces as the packaging material demand decreases. This force or speed is transmitted back to some device that in turn reduces the packaging material supply to attempt to maintain a relatively constant wrap force.

With the ever faster wrapping rates demanded by the industry, the rotation speeds have increased significantly to a point where the concept of sensing demand change and altering supply speed is no longer effective. The delay of response has been observed to begin to move out of phase with rotation at approximately 20 RPM. The actual response time for the rotating mass of packaging material roll and rollers approximating 100 lbs must shift from accelerate to decelerate eight times per revolution that at 20 RPM is a shift more than every ½ sec.

Even more significant is the need to minimize the acceleration and deceleration times for these faster cycles. Initial acceleration must pull against the clamped packaging material, which typically cannot stand a high force especially the high force of rapid acceleration that cannot be maintained by the feedback mechanisms described above. Use of high speed wrapping has therefore been limited to relatively lower wrap forces and pre-stretch levels where the loss of control at high speeds does not produce undesirable packaging material breaks.

Packaging material dispensers mounted on rotating rings present additional special issues concerning effectively wrapping at high speeds. Many commercially available rotating ring wrappers that are in use depend upon electrically powered motors to drive the packaging material dispensers. The power for these motors must be transmitted to the rotating ring. This is typically done through electric slip rotating rings mounted to the rotating ring with an electrical pick up fingers mounted to the fixed frame. Alternately others have attempted to charge a battery or run a generator during rotation. All of these devices suffer complexity, cost and maintenance issues. But even more importantly they add significant weight to the rotating ring which impacts its ability to accelerate and/or decelerate rapidly.

Packaging material dispensers mounted on vertically rotating rings have the additional problem of gravity forces added to centrifugal forces of high-speed rotation. High-speed wrappers have therefore required expensive and very heavy two part bearings to support the packaging material dispensers. The presence of the outer race on these bearings has made it possible to provide a belt drive to the pre-stretch dispenser. This drive is taken through a clutch type torque device to deliver the variable demand rate required for wrap force desired.

The present disclosure is directed to overcoming one or more of the above-noted problems.

SUMMARY

According to one aspect of the present disclosure, an apparatus for wrapping a load may include a film dispenser for dispensing a film web including a film dispensing drive. The apparatus may also include a rotational drive system for providing relative rotation between the load and the dispenser during a wrapping cycle. The apparatus may further include a controller configured to operatively couple the film dispensing drive and the rotational drive system such that, for any portion of a revolution of the film dispenser relative to the load during the wrapping cycle, the film dispenser dispenses a selected length of the film web corresponding to the portion of the revolution.

According to another aspect of the present disclosure, an apparatus for wrapping a load may include a packaging material dispenser for dispensing a film web including a film dispensing drive. The apparatus may also include a rotational drive system for providing relative rotation between the load and the dispenser during a wrapping cycle. The apparatus may further include a controller configured to select a length of the film web to be dispensed for at least a portion of a revolution of the dispenser relative to the load during the wrapping cycle. The controller may also be configured to drive the rotational drive system and the dispensing drive at a ratio that will result in the dispenser dispensing the selected length of film web for the portion of the revolution of the dispenser relative to the load during the wrapping cycle.

According to yet another aspect of the present disclosure, an apparatus for wrapping film around a load may include a film dispenser configured to dispense film to be applied to the load. The film dispenser may include a film dispensing drive for rotating at least one film dispenser roller. The apparatus may also include a rotation assembly configured to rotate the film dispenser relative to the load. The rotation assembly may also include a rotational drive. The rotation assembly may further include a control system configured to electronically control the operation of one of the film dispensing drive and the rotational drive based at least in part on the operation of the other of the film dispensing drive and the rotational drive.

According to yet another aspect of the present disclosure, a method of wrapping a load may include providing a film dispenser for dispensing a film web. The method may also include operating a rotational drive to provide relative rotation between the film dispenser and the load during a wrapping cycle. The method may further include operating a film dispensing drive of the film dispenser to dispense the film web during the wrapping cycle. The method may also include electronically coupling the rotational drive to the film dispensing drive and proportionally controlling the drives to dispense a selected length of the film web during at least a portion of a revolution of the film dispenser around the load during the wrapping cycle.

According to yet another aspect of the present disclosure, a method of sensing a change in a girth of a load or a length of a side of a load during a wrapping cycle may include providing relative rotation between a film dispenser and the load to dispense film to be wrapped around the load. The method may also include sensing an actual speed of an idle roller positioned downstream of the film dispenser as the film is dispensed. The method may further include comparing the actual speed of the idle roller to an expected speed of the idle roller. The method may also include determining that the girth of the load or the length of a side of the load has changed when the actual speed does not equal the expected speed.

According to yet another aspect of the present disclosure, a method of wrapping a plurality of loads may include providing a first load on a wrapping surface. The method may also include, based at least in part on a girth of the first load, determining a selected length of film to be dispensed for at least a portion of a rotation of a film dispenser relative to the first load during a wrapping cycle. The method may further include providing relative rotation between the film dispenser and the first load to dispense the selected length of film for the at least a portion of a rotation of the film dispenser relative to the first load during the wrapping cycle to wrap the first load. The method may also include providing a second load on the wrapping surface. The method may further include sensing that the girth of the second load is different from the girth of the first load. The method may also include, based at least in part on the girth of the second load, automatically selecting a new length of film to be dispensed for at least a portion of a rotation of the film dispenser relative to the second load during a wrapping cycle.

According to yet another aspect of the present disclosure, an apparatus for wrapping a load may include a film dispenser for dispensing a film web. The apparatus may also include a rotational drive system for providing relative rotation between the load and the dispenser to dispense a selected length of film for at least a portion of a rotation during a wrapping cycle. The apparatus may further include an idle roller positioned downstream of the film dispenser.

The idle roller may be configured to react to a change in a length of a portion of the load being wrapped. The apparatus may also include a controller configured to select a new length of film to be dispensed for at least a portion of a rotation of the film dispenser relative to the load during the wrapping cycle in response to the reaction of the idle roller.

According to yet another aspect of the present disclosure, a method of sensing a film break during a wrapping cycle may include providing relative rotation between a film dispenser and a load to dispense film to be wrapped around the load. The method may also include sensing an actual speed of an idle roller as the film is dispensed. The method may further include comparing the actual speed of the idle roller to an expected speed of the idle roller. The method may also include determining that the film has broken when the actual speed differs from the expected speed by a selected amount.

According to yet another aspect of the present disclosure, an apparatus for wrapping a load may include a film dispenser for dispensing a film web. The apparatus may also include a rotational drive system for providing relative rotation between the load and the dispenser to dispense film to be wrapped around the load. The apparatus may further include an idle roller. The apparatus may also include a controller configured to compare an actual speed of the idle roller to an expected speed of the idle roller. The controller may also be configured to stop the rotational drive system if the actual speed differs from the expected speed by a selected amount.

According to yet another aspect of the present disclosure, a method of automatically adjusting a selected length of film to be dispensed in response to a change in a length of a portion of the load being wrapped during a wrapping cycle may include providing relative rotation between a film dispenser and the load to dispense the selected length of film to be wrapped around the load during at least a portion of a rotation of the dispenser relative to the load during a wrapping cycle. The method may also include sensing movement of the dispensed film. The method may further include comparing the sensed movement of the dispensed film to expected movement of the dispensed film. The method may also include adjusting the selected length of film to be dispensed during at least a portion of a rotation of the dispenser relative to the load during the wrapping cycle in response to a difference between the sensed movement and the expected movement.

According to yet another aspect of the present disclosure, an apparatus for wrapping a load may include a film dispenser for dispensing a film web including a film dispensing drive. The apparatus may also include a rotational drive system for providing relative rotation between the load and the dispenser during a wrapping cycle. The apparatus may further include a controller configured to mimic a mechanical link between the film dispensing drive and the rotational drive system. The controller may be further configured to operate the dispensing drive and the rotational drive system at a first ratio during a first portion of a wrapping cycle, and at a second ratio during a second portion of the wrapping cycle.

According to yet another aspect of the present disclosure, a method of wrapping a load may include providing relative rotation between a film dispenser containing roll of film and a load to dispense the film to be wrapped around the load. The method may also include monitoring rotation of a driven roller in the film dispenser as the film is dispensed. The method may further include calculating, based on the rotation of the driven roller, an amount of film remaining on the film roll. The method may also include determining a number of loads that can be wrapped at current settings from the amount of film remaining on the film roll.

According to yet another aspect of the present disclosure, a method of sensing a film break in film to be wrapped around a load may include providing relative rotation between a film dispenser and the load to dispense the film around the load. The method may also include engaging the dispensed film with an idle roller. The method may further include monitoring a direction of rotation of the idle roller. The method may also include determining that the film has broken when the direction of rotation of the idle roller reverses.

According to yet another aspect of the present disclosure, a method of wrapping a load may include providing a film dispenser for dispensing a film web. The method may also include operating a rotational drive to provide relative rotation between the film dispenser and the load during a wrapping cycle. The method may further include operating a film dispensing drive of the film dispenser to dispense the film web during the wrapping cycle. The method may also include monitoring an idle roller configured to rotatably engage the film web. The method may further include comparing an expected speed of the idle roller to an actual speed of the idle roller. The method may also include proportionally controlling speeds of the rotational drive and the film dispensing drive to minimize a difference between the actual speed and the expected speed.

According to yet another aspect of the present disclosure, a method of wrapping a load may include providing a film dispenser for dispensing film. The method may also include operating a rotational drive to provide relative rotation between the film dispenser and the load during a wrapping cycle. The method may further include operating a film dispensing drive of the film dispenser to dispense the film during the wrapping cycle. The method may also include sensing a demand for film for wrapping the load with an idle roller configured to rotatably engage the dispensed film. The method may further include adjusting the film dispensing drive based on the sensed demand.

According to yet another aspect of the present disclosure, a method of wrapping a load may include providing a film dispenser for dispensing a film web. The method may also include operating a rotational drive at a first rotational drive speed to provide relative rotation between the film dispenser and the load during a wrapping cycle. The method may further include operating a film dispensing drive of the film dispenser at a first film dispensing drive speed to dispense the film web during the wrapping cycle. The method may also include monitoring an idle roller configured to rotatably engage the film web. The method may further include comparing an expected speed of the idle roller to an actual speed of the idle roller. The method may also include varying at least one of the first rotational drive speed and the first film dispensing drive speed until the actual speed equals the expected speed.

According to yet another aspect of the present disclosure, a method of wrapping a load may include providing relative rotation between a film dispenser and the load during a wrapping cycle. The method may also include dispensing a film web from a prestretch portion of a film dispenser at a first rate. The method may further include sensing a film demand of the load downstream of the prestretch portion of the dispenser. The method may also include controlling a speed of film dispensing to match the sensed demand.

According to yet another aspect of the present disclosure, a method of wrapping a load may include providing relative rotation between a film dispenser and the load during a wrapping cycle. The method may also include dispensing a film web from a prestretch portion of a film dispenser at a first rate. The method may further include sensing a characteristic of the film web downstream of the prestretch portion of the dispenser. The method may also include controlling a speed of film dispensing based on the sensed characteristic.

DESCRIPTION OF THE EXEMPLARY EMBODIMENTS

Figure 1:
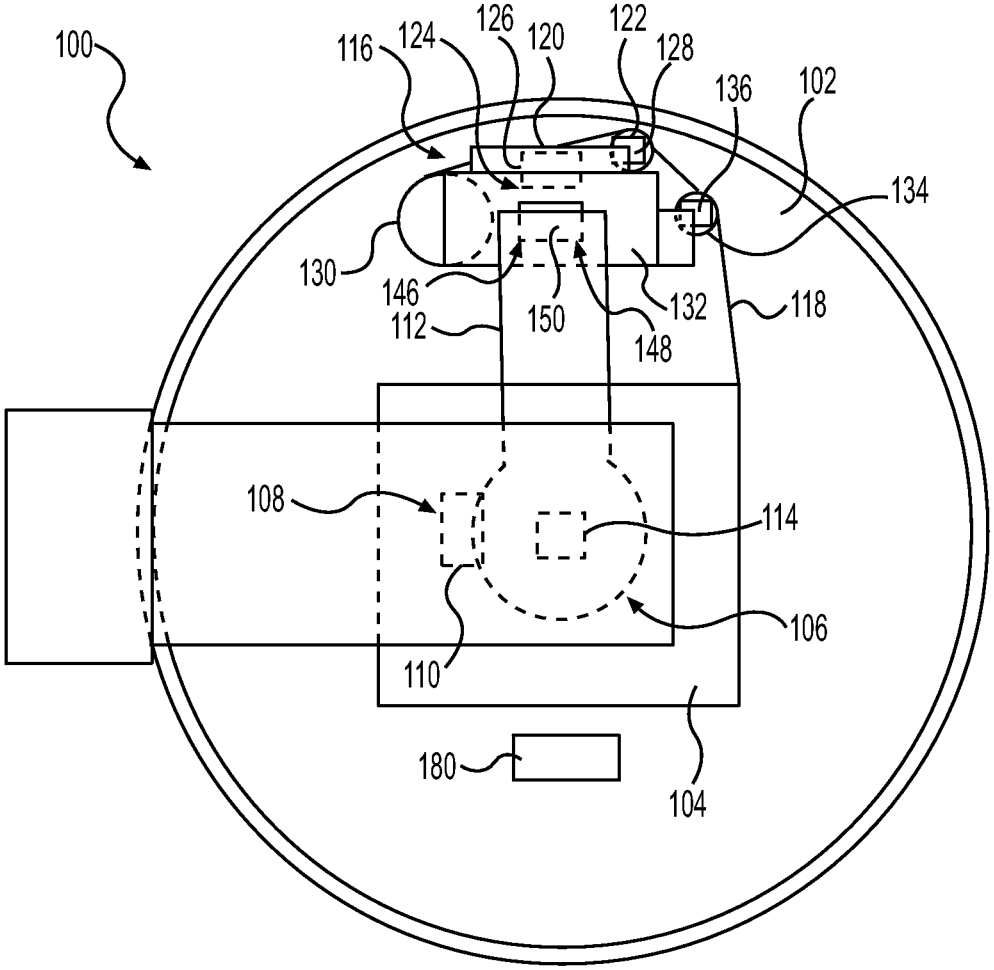
FIG. 1 shows a top view of a first exemplary wrapping apparatus according to one aspect of the present disclosure.

Reference will now be made in detail to the present embodiment of the disclosure, an example of which is illustrated in the accompanying drawings.

The present disclosure provides a method and apparatus for dispensing a selected length of packaging material per revolution of a packaging material dispenser around a load during at least a portion of a wrapping cycle. As used herein, the term "selected" may include the following: calculated using mathematical equations and/or algorithms, found through experimenting with different settings to find a setting or settings that produce a desired result, found by analyzing historical performance data to find a setting or settings that have produced desired results in the past, found by obtaining and using input data (e.g., sensor data or any other suitable input data) describing a setting or settings that produce desired results, and/or input by a user. Set, preset, determined, and predetermined values and settings may also be included. It should be understood that the process of selecting values or settings for a wrapping cycle may occur prior to the start of the wrapping cycle, during the wrapping cycle in real time, and/or after a previous wrapping cycle has been performed.

The packaging material dispenser may include a packaging material roller driven to dispense packaging material by a packaging material drive system. The packaging material dispenser may be rotated about the load to be wrapped, or the load may be rotated relative to the packaging material dispenser. In any case, a rotational drive system is used to provide the relative rotation between the dispenser and the load. The rotational drive system may be configured to drive a rotating ring (vertical or horizontal), a rotating turntable, or a rotating arm. A link may be used to operatively couple the rotational drive system and the packaging material drive system. The link may be mechanical or electronic. If electronic, the link may mimic or simulate a mechanical link. Thus, rotation of the packaging material roller may be linked to the relative rotation of the packaging material dispenser relative to the load. The relationship between the rotational drive system and the packaging material drive system may be used to dispense the selected length of film during relative rotation between load and dispenser during at least a portion of the wrapping cycle.

The selected length of packaging material dispensed per relative revolution may be determined based upon packaging material demand. As used herein, packaging material demand is defined as load girth multiplied by payout percentage. That is, demand is the amount of film needed to wrap the load at the selected payout percentage. As used herein, load girth is a length equal to the perimeter of the load to be wrapped. As used herein, payout percentage is defined as the percent of load girth dispensed for a revolution of the packaging material dispenser relative to the load. For example, if a load girth is 100 inches and the length of film dispensed during one relative rotation is 100 inches, then payout percentage equals 100%. Similarly, if load girth is 100 inches and a length of film of 90 inches is dispensed during one revolution, the payout percentage equals 90%. Thus, demand does not assume a one to one ratio between the girth of the load (or length of the portion of the load being wrapped) and the amount of film being dispensed to wrap the girth of the load (or amount of film being dispensed to wrap the length of the portion of the load being wrapped), such a one to one ratio is found only when payout percentage is 100%. Test results have shown that good wrapping performance in terms of load containment (wrap force) and optimum packaging material use (efficiency) is obtained by dispensing a length of packaging material that is between approximately 75% and approximately 130% of load girth. Factors that may affect the results may include, for example, an amount the film is pre-stretched, the elasticity of the film, film gauge, film quality, and gel level.

The girth of a load may be measured using a measuring tape, or using one or more sensing devices configured to recognize the location of corners, edges, or surfaces of the load. Girth may also be measured using an assembly and methodology that will be described in detail in the paragraphs below. The payout percentage may be selected based on the desired wrap force and/or containment force. As used herein, wrap force is defined as the force exerted on the load by an individual web of film applied to the load. Decreasing the payout percentage may cause the wrap force exerted by the packaging material on the load to increase (assuming other factors affecting wrap force remain constant), while increasing the payout percentage may cause the wrap force to decrease (assuming other factors affecting wrap force remain constant). As used herein, containment force is defined as the force exerted on the load by cumulative layers of film. The containment force may be generated by the wrap forces exerted on the load by multiple layers of film.

According to one aspect of the present disclosure, a wrapping apparatus 100, shown in FIG. 1, may include a load support surface 102 for supporting a load 104 to be wrapped, and a relative rotation assembly 106. Relative rotation assembly 106 may include a rotational drive system 108, including, for example, an electric motor 110, that may be configured to rotate a rotating arm 112 relative to load 104. It should be understood that rotating arm 112 is provided as an example, and that a rotating ring or rotating turntable may be used in place of rotating arm 112 on a different type of wrapping apparatus (e.g., those shown in FIGS. 3 and 4). In any case, rotational drive system 108 would operate in a similar manner to provide relative rotation between the load and the packaging material dispenser. A sensor assembly 114 may be provided for sensing the rotation of rotating arm 112 and/or rotational drive system 108. Sensor assembly 114 may include a sensing device, such as that shown in FIG. 2. Sensing device 144 may be mounted on rotating arm 112, or any other suitable part of wrapping apparatus 100.

Wrapping apparatus 100 may also include a packaging material dispenser 116 mounted on rotating arm 112. Packaging material dispenser 116 may be configured to dispense packaging material as it rotates relative to load 104. In an exemplary embodiment, packaging material dispenser 116 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, or tape.

Figure 2:
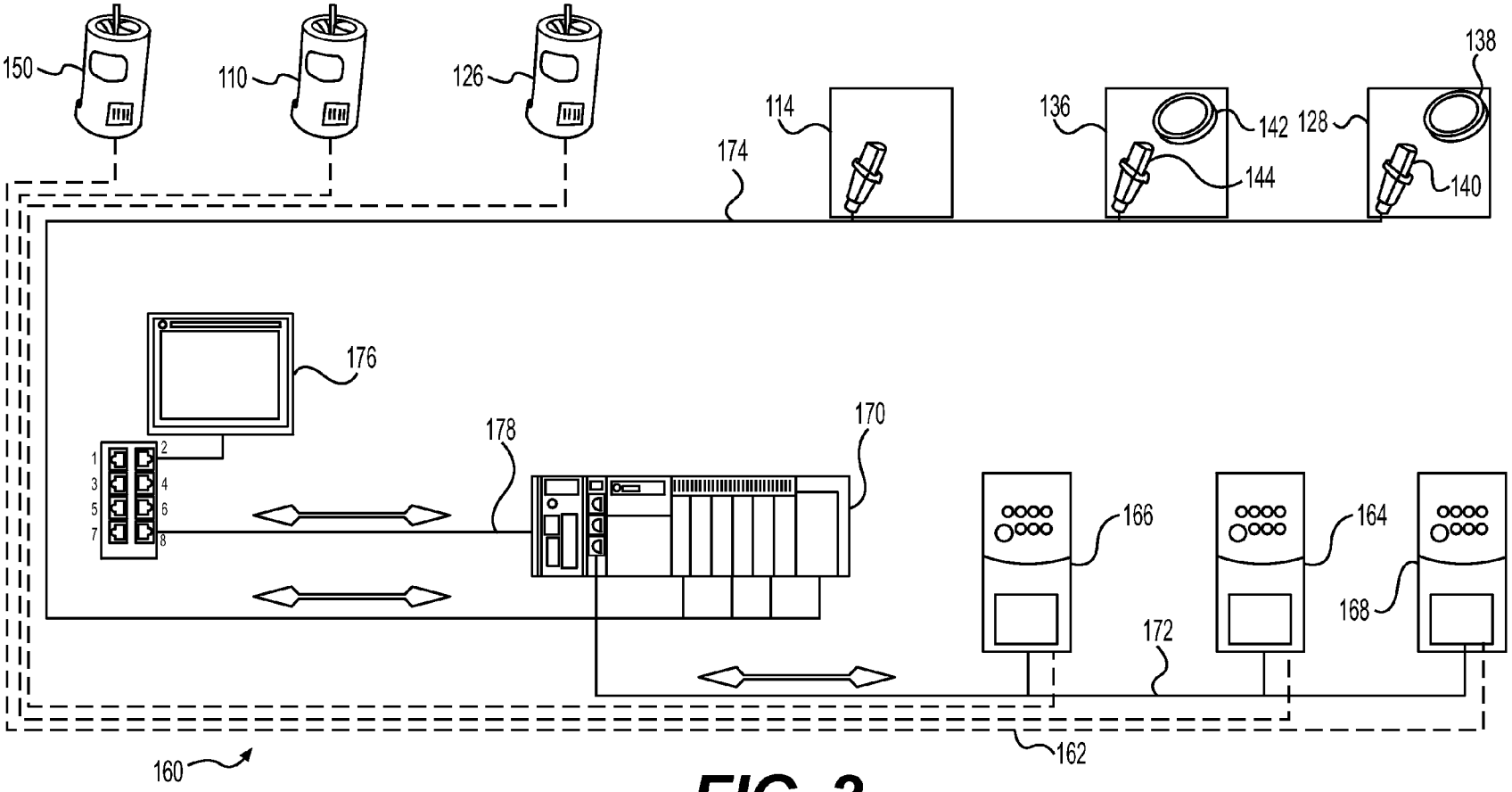
FIG. 2 is a schematic showing an exemplary control system according to one aspect of the present disclosure.

Packaging material dispenser 116 may include a packaging material dispensing assembly 120 configured to pre-stretch packaging material before it is applied to load 104 if pre-stretching is desired, or to dispense packaging material to load 104 without pre-stretching. Packaging material dispensing assembly 120 may include a packaging material roller 122 and one or more additional driven rollers (not shown) as would be apparent to one skilled in the art. A packaging material drive system 124, including, for example, an electric motor 126, may be used to rotate packaging material roller 122. A sensor assembly 128 may be provided for sensing the rotation of packaging material roller 122 and/or a speed of the packaging material drive system 124. Sensor assembly 128, as shown in FIG. 2, may include one or more magnetic transducers 138 mounted on packaging material roller 122, and a sensing device 140 configured to generate a pulse when the one or more magnetic transducers 138 are brought into proximity of sensing device 140. Alternatively, sensory assembly 128 may include an encoder configured to monitor rotational movement. The encoder may be capable of producing 720 signals per revolution of packaging material roller 122 to describe the rotation of packaging material roller 122. The encoder may be mounted on a shaft of packaging material roller 122, on electric motor 126, and/or any other suitable area. One example of a sensor assembly that may be used is a Sick 7900266 Magnetic Sensor and Encoder. Other suitable sensors and/or encoders known in the art may be used, such as, for example, magnetic encoders, electrical sensors, mechanical sensors, photodetectors, and/or motion sensors.

Packaging material 118 may be passed through packaging material dispensing assembly 120 from a roll 130 of packaging material 118 rotatably mounted on a roll carriage 132 of packaging material dispenser 116. When packaging material 118 leaves packaging material dispensing assembly 120, it may engage an idle roller 134, rotatably mounted on packaging material dispenser 116 downstream of packaging material roller 122, before being applied to load 104. Thus, the rotational speed of idle roller 134 may correspond to the speed of packaging material 118 moving across the surface of idle roller 134. Accordingly, idle roller 134 may react to an increase in the speed of packaging material 118 moving across its surface by increasing in speed, while idle roller 134 may react to a decrease in the speed of packaging material 118 moving across its surface by decreasing in speed. The idle roller 134 may be positioned at any location between the packaging material roller 122 and the load 104.

A sensor assembly 136 may be provided for sensing the rotation of idle roller 134. Sensor assembly 136, as shown in FIG. 2, may include one or more magnetic transducers 142 mounted on idle roller 134, and a sensing device 144 configured to generate a pulse when the one or more magnetic transducers 142 are brought into the proximity of the sensing device. Alternatively, sensor assembly 136 may include an encoder configured to monitor rotational movement. The encoder may be capable of producing 720 signals per revolution of idle roller 134 to describe the rotation of idle roller 134. The encoder may be mounted on a shaft of idle roller 134 or any other suitable area. One example of a sensor assembly that may be used is the Sick 7900266 Magnetic Sensor and Encoder. Other suitable sensors and/or encoders known in the art may be used, such as, for example, magnetic encoders, electrical sensors, mechanical sensors, photodetectors, and/or motion sensors.

Wrapping apparatus 100 may further include a lift assembly 146. Lift assembly 146 may be powered by a lift drive system 148, including, for example, an electric motor 150, that may be configured to move packaging material dispenser 116 vertically relative to load 104. Lift drive system 148 may drive packaging material dispenser 116 upwards and downwards vertically on rotating arm 112 while packaging material dispenser 116 is rotated about load 104 by rotational drive system 108, to wrap packaging material spirally about load 104.

An exemplary schematic of a control system 160 for a wrapping apparatus including packaging material dispensing assembly 120 is shown in FIG. 2. Rotational drive system 108, packaging material drive system 124, and lift drive system 148 may communicate through one or more data links 162 with a rotational drive variable frequency drive ("VFD") 164, a packaging material drive VFD 166, and a lift drive VFD 168, respectively. A VFD is a system for controlling the rotational speed of an electric motor by controlling the frequency of the electrical power supplied to the motor. Thus, by adjusting the frequency of the electrical power supplied to the motor, the VFD can set the electric motor anywhere at or between zero speed and the maximum speed of the motor. Accordingly, each of rotational drive VFD 164, packaging material drive VFD 166, and lift drive VFD 168, may control the motor speed of its respective drive system by the principle described above. An exemplary VFD may include the PowerFlex VFD produced by Allen-Bradley, however, any suitable VFD or other control may be used.

The VFD may express an actual speed of a motor as a percentage of the maximum speed of the motor. The VFD and the motor it controls may be calibrated such that motor speeds expressed in terms of percentage of maximum speed may be translated into some other unit, such as, for example, revolutions per minute. This may be accomplished by using a sensor or similar device to determine the maximum speed of the motor in revolutions per minute while it is running at 100%. Then, whenever the motor speed is expressed as a percentage of the maximum speed, a simple mathematical calculation may be used to convert the motor speed into revolutions per minute. The calculation may entail multiplying the motor speed expressed as a percentage by the maximum speed in revolutions per minute, and dividing the resultant value by 100.

Rotational drive VFD 164, packaging material drive VFD 166, and lift drive VFD 168 may communicate with a controller 170 through a data link 172. It is contemplated that data link 162 and/or data link 172 may include, for example, data transmission lines (e.g., Ethernet connections), and/or any known wireless communication medium. Controller 170 may include hardware components and software programs that allow it to receive, process, and transmit data. It is contemplated that controller 170 may operate similar to a processor in a computer system. Controller 170 may communicate with sensor assemblies 114, 128, and 136 through a data link 174, thus allowing controller 170 to receive data on rotating arm 112, packaging material roller 122, and idle roller 134. Controller 170 may also communicate with an operator interface 176 via a data link 178. Operator interface 176 may include a screen and controls that may provide an operator with a way to monitor, program, and operate wrapping apparatus 100. For example, an operator may use operator interface 176 to enter or change the girth in inches, the payout percentage, values used in calculations, or to start, stop, or pause the wrapping cycle.

The dispensing of the selected length of packaging material during a relative rotation of a wrapping cycle may be dependent upon packaging material demand, and independent of the speed of the relative rotation. It may be independent of the speed of the relative rotation because a relationship between the speed of rotational drive system 108 and the speed of packaging material drive system 124, may be calculated or otherwise obtained, and implemented and maintained electronically for at least a portion of the wrapping cycle. Thus, the packaging material drive speed may change accordingly with the relative rotation speed. This may be achieved through linking the drive speeds such that the speeds vary together according to a fixed ratio between the packaging material drive speed and the relative rotation speed. That is, for one or more revolutions of packaging material dispenser 116 relative to load 104 during a wrapping cycle, regardless of the speed of the relative rotation, packaging material roller 122 may complete a selected number of revolutions per one revolution of rotating arm 112. If the speed of rotational drive system 108 increases, the speed of packaging material drive system 124 also increases, thus decreasing the amount of time it takes for packaging material roller 122 to complete the selected number of revolutions. Similarly, if the speed of rotational drive system 108 also decreases, the speed of packaging material drive system 124 decreases, thus increasing the amount of time required for packaging material roller 122 to complete the selected number of revolutions. Because the speed of the relative rotation is tied to the speed of the packaging material feed (i.e., packaging material roller 122) through the electronic link provided by control system 160, the relationship between the speeds can be maintained with accuracy and without requiring mechanical linking components physically connecting rotational drive system 108 to packaging material drive system 124. For example, packaging material drive system 124 may be controlled to run at a percentage of rotational drive system 108 (calculated or obtained) in order to obtain a desired number of rotations of packaging material roller 122 and thus dispense a desired length of film. The link may be established between a rotational drive system and a film dispensing roller in a dispenser regardless of whether the dispenser utilizes pre-stretching.

Accordingly, during acceleration and deceleration of rotational drive system 108, packaging material drive system 124 also accelerates and decelerates correspondingly. The ability of rotational drive system 108 and packaging material drive system 124 to accelerate and decelerate together is a particular advantage when a rotatable ring is part of the means of providing relative rotation. The rotatable ring may be powered by, for example, an electric motor 210, for very rapid acceleration to over 60 rpm with an acceleration period of one second and a deceleration period of one second. Since the packaging material feed may correspond to the relative rotational speed as described above, there is little to no extra force on the packaging material during acceleration or excess packaging material during deceleration.

The electronic link between rotational drive system 108 and packaging material drive system 124 will now be described in more detail. In order to set the wrapping parameters for wrapping apparatus 100, controller 170 may obtain or be provided with a value "G" indicative of load girth of the load to be wrapped, and a value "P" indicative of the payout percentage that may help produce a desirable wrap force. Controller 170 may calculate a value "D" indicative of film demand using the following equation:

$$D=G\times(P\div 100)$$

Controller 170 may obtain or be provided with a value "$C_{pmr}$" indicative of the circumference of packaging material roller 122, and may calculate a value "$N_{prr}$" indicative of the number of revolutions packaging material roller 122 must undergo per one revolution of packaging material dispenser 116 relative to load 104 (e.g., one revolution of rotating arm 112) to meet the demand "D" using the following equation:

$$N_{prr}=D\div C_{pmr}$$

If known, controller 170 may also obtain a value "$S_{rot}$" indicative of the speed of rotational drive system 108 in revolutions per minute. If unknown, controller 170 may calculate the value $S_{rot}$. Controller 170 may do this by obtaining, using rotational drive VFD 164, a value "$S_{\%maxrot}$" indicative of the speed of rotational drive system 108 expressed as a percentage of the maximum speed of rotational drive system 108. For example, if the rotational drive system is capable of running at a maximum of 40 rpm, but is currently running at 30 rpm, VFD 164 would express the value as $S_{\%maxrot}$=(30 rpm/40 rpm)×100, or 75%. A value "$S_{maxrot}$" indicative of the maximum speed of rotating arm 112 in revolutions per minute may be determined by calibrating rotational drive system 108 and rotational drive VFD 164. Calibration may include running electric motor 110 of rotational drive system 108 at maximum speed, or a level that rotational drive VFD 164 recognizes as its maximum level (e.g., 100%). Using sensor assembly 114, or by some other means, controller 170 may obtain the number of revolutions per minute of rotating arm 112 while rotational drive system 108 is running at maximum speed. Using these values, controller may calculate $S_{rot}$ using the following equation:

$$S_{rot}=(S_{\%maxrot}\div 100)\times S_{maxrot}$$

Controller 170 may use the number of revolutions required of packaging material roller 122 represented by value "$N_{prr}$" and $S_{rot}$ to calculate a value "$S_{pmr}$" indicative of the necessary speed of packaging material roller 122 (in revolutions per minute) to achieve the required number of rotations $N_{prr}$ of packaging material roller 122 during relative rotation using the following equation:

$$S_{pmr}=N_{prr}\times S_{rot}$$

The immediately preceding equation helps to explain the relationship between $S_{pmr}$ and $S_{rot}$ by showing how $S_{pmr}$ may be determined based on $S_{rot}$. Thus, it should be apparent that an increase or decrease in $S_{rot}$ may produce a corresponding increase or decrease in $S_{pmr}$, such that desired packaging material demand D may be achieved during wrapping regardless of changes in $S_{rot}$ (rotational drive speed) or $S_{pmr}$ (packaging material drive speed).

Controller 170 may set packaging material drive system 124 so that it operates at $S_{pmr}$ using packaging material drive VFD 166. To do this, controller 170 may use $S_{pmr}$, and a value "$S_{maxpmr}$" indicative of the maximum speed of packaging material roller 122 (i.e., the speed of packaging material roller 122 in revolutions per minute with packaging material drive system 124 at maximum speed), to calculate a value "$S_{\%maxpmr}$" indicative of the speed of packaging material drive system 124 expressed as a percentage of the maximum speed of packaging material roller 122, using the following equation:

$$S_{\%maxpmr}=(S_{pmr}\div S_{maxpmr})\times 100$$

The maximum speed of packaging material drive system 124 in revolutions per minute, $S_{maxpmr}$, may be determined by calibrating packaging material drive system 124 and packaging material drive VFD 166. Calibration may include running electric motor 126 of packaging material drive system 124 at maximum speed, or a level that packaging material drive VFD 166 recognizes as its maximum level (e.g., 100%). Using sensor assembly 128, controller 170 may determine the number of revolutions per minute of packaging material roller 122 at the maximum speed, thus providing $S_{maxpmr}$. $S_{maxpmr}$ may be determined by other appropriate means or provided by a user.

Controller 170 may instruct packaging material drive VFD 166 to run electric motor 126 so that packaging material roller 122 rotates at the rate corresponding to $S_{\%maxpmr}$. Additionally, controller 170 may use the equations above to adjust the speed of electric motor 126 when one or more of the values used in the equations above changes in order to maintain the relationship between rotational drive speed and packaging material drive speed.

It is known that load girth can be measured by hand, for example, by using a ruler or measuring tape. However, measuring each load by hand may be cumbersome and inefficient. It is also known that load girth may be determined using proximity sensors, photocell devices, and other suitable detection assemblies that are known in the art. These detection assemblies may locate corners, edges, or surfaces of a load, and based on this information, load girth may be determined. However, such assemblies may add to the complexity of a stretch wrapping machine, and may be expensive. If load girth G is obtained by one of these or other known systems and methods, it may be provided as in input to controller 170 for purposes of the above calculations.

According to another aspect of the present disclosure, load girth may be determined in real time during a wrapping cycle using control system 160. This arrangement determines load girth quickly and accurately without the disadvantages associated with known systems and methods.

Idle roller 134 may rotate as packaging material 118 from packaging material roller 122 engages idle roller 134 while on its way to load 104. As idle roller 134 rotates, one or more transducers 142 mounted on idle roller 134 may come into and out of range of sensing device 144. Each time one or more transducers 142 comes into range of sensing device 144, a pulse may be produced by sensing device 144. Controller 170 may monitor the number, frequency, and timing of the pulses. Since controller 170 may also monitor the revolutions of rotating arm 112 using sensor assembly 114, controller 170 may have the ability to determine a value "$N_{ir}$," which may be indicative of the number of pulses of idle roller 134 per one revolution of rotating arm 112. A value "T," which may be indicative of the number of transducers 142 mounted on idle roller 134, may be programmed into controller 170, or may be entered using operator interface 176. Using the following equation, controller 170 may calculate a value "Y" indicative of the number of revolutions of idle roller 134 per revolution of rotating arm 112:

$$Y=N_{ir}\div T$$

By obtaining a value "$C_{ir}$" indicative of a circumference of idle roller 134 through information entered at operator interface 176 or by any other means, controller 170 may calculate a value "$G_c$" indicative of load girth. The calculated load girth $G_c$ may be found using the following equation:

$$G_c=Y\times C_{ir}$$

The value $G_c$ may be used as the load girth G by controller 170 to calculate the desired speed $S_{pmr}$ of packaging material roller 122. Thus, if load girth changes during a wrapping cycle, such as, for example, when a load has an irregularly shaped section, or an incomplete layer, controller 170 may use $G_c$ to calculate a new $S_{pmr}$ so that the relationship between the speeds of rotational drive system 108 and packaging material drive system 124 may be continuously updated to reflect any change in packaging material demand. Additionally or alternatively, controller 170 may recognize that load girth has changed upon comparing $G_c$ to the previous load girth value. Controller 170 may then use $G_c$ to calculate a new $S_{pmr}$ so that the relationship between the speeds of rotational drive system 108 and packaging material drive system 124 may be continuously updated to reflect any change in packaging material demand. This may help to ensure that a substantially constant payout percentage may be achieved during at least a portion of the wrapping cycle, regardless of variations in load girth. It is also contemplated that controller 170 may continuously calculate $G_c$ as part of a process for ensuring that a length of film equal to the demand D is being provided during relative rotation between load 104 and packaging material dispenser 116 during at least a portion of the wrapping cycle.

Additionally, if load girth changes between wrapping cycles, such as, for example, when different sized or shaped loads are wrapped in succession, controller 170 may recognize the difference between the load girths, and may account for the change so that the relationship between the speeds of rotational drive system 108 and packaging material drive system 124 may be updated when packaging material demand D varies between wrapping cycles due to changes in girth G. This may help to ensure that a substantially constant payout percentage may be achieved across wrapping cycles, even if load girth varies.

The equations above for determining $G_c$ help to explain the relationship between load girth and the rotational speed of idle roller 134. For example, an increase in load girth may produce an increase in film demand, which in turn may increase the speed of film passing across the surface of idle roller 134. As the speed of the film increases, so does the value "Y" indicative of the number of revolutions of idle roller 134 per revolution of rotating arm 112. This means that the increase in load girth produces an increase in the rotational speed of idle roller 134 to a speed greater than the previous or expected speed from before the increase in load girth. The increase in the value "Y" in turn gives rise to a new value for $G_c$ greater than the previous value from before the increase in load girth.

A decrease in load girth may produce a decrease in film demand, which in turn may decrease the speed of film passing across the surface of idle roller 134. As the speed of the film decreases, so does the value "Y" indicative of the number of revolutions of idle roller 134 per revolution of rotating arm 112. This means that the decrease in load girth produces a decrease in the rotational speed of idle roller 134 to a speed less than the previous or expected speed from before the decrease in load girth. The decrease in the value "Y" in turn gives rise to a new value for $G_c$ less than the previous value from before the decrease in load girth.

While a change in load girth may produce a change in idle roller speed, causing the actual speed of idle roller 134 to differ from the expected speed of idle roller 134 as described above, controller 170 may take actions to minimize the difference between the actual speed and the expected speed.

For example, when load girth increases, idle roller speed may increase as a result. Thus, the actual idle roller speed after the increase in load girth may exceed the previous or expected idle roller speed from before the increase. As the idle roller speed increases, $G_c$ also increases as a result, as explained by the equations used to calculate $G_c$ described above. When controller 170 performs calculations with the newly obtained values, then in accordance with the equations used to calculate the speed of packaging material roller 122 "$S_{pmr}$" described above, the increased $G_c$ will increase $S_{pmr}$. As $S_{pmr}$ increases, more film is dispensed. The additional film may compensate for the increase in load girth and film demand, thus slowing the speed of film passing across the surface of idle roller 134 and the rotational speed of idle roller 134. This reduction in speed may bring the actual speed of idle roller 134 closer to the expected speed of idle roller 134 from before the increase in load girth.

When load girth decreases, idle roller speed may decrease as a result. Thus, the actual idle roller speed after the decrease in load girth may fall below the previous or expected idle roller speed from before the decrease. As the idle roller speed decreases, $G_c$ also decreases as a result, as explained by the equations used to calculate $G_c$ described above. When controller 170 performs its calculations with the newly obtained values, then in accordance with the equations used to calculate the speed of packaging material roller 122 "$S_{pmr}$" described above, the decreased $G_c$ will decrease $S_{pmr}$. As $S_{pmr}$ decreases, less film is dispensed. The reduced film feed may compensate for the decrease in load girth and film demand, thus increasing the speed of film passing across the surface of idle roller 134 and the rotational speed of idle roller 134. This increase in speed may bring the actual speed of idle roller 134 closer to the expected speed of idle roller 134 from before the decrease in load girth. By performing the steps described above repeatedly or continuously during a wrapping cycle, controller 170 may adjust the ratio of film dispensing drive to rotational drive to minimize the difference between the actual speed and the expected speed of idle roller 134, thereby maintaining the desired payout percentage.

The method and equations described above provide a means for determining load girth $G_c$ using a full sampling, that is, using values obtained from a full revolution of rotating arm 112. However, load girth $G_c$ may also be determined using less than a full sampling. For example, load girth $G_c$ may be determined using a half sampling (a half revolution of rotating arm 112). This may entail controller 170 obtaining values and performing calculations as described above, but for a half sample, that is, one half revolution of rotating arm 112. When controller 170 has determined load girth $G_c$ for half of a revolution, controller 170 may double that load girth to provide an estimate of the load girth $G_c$ encountered during a full revolution of rotating arm 112. It should be understood that this method for partial sampling may be used for any fraction of a revolution of rotating arm 112. Thus, if the controller 170 is continuously calculating the load girth $G_c$, the relative or corresponding portion of the load girth $G_c$ for any portion of a revolution of the dispenser relative to the load may be identified or calculated.

It should also be understood that the accuracy of partial sampling may increase as the partial sample approaches a full revolution of rotating arm 112. For example, if a load is rectangular shaped with a long side and a short side, a quarter sample may be taken for the long side of the load only. Thus, when the load girth $G_c$ from the quarter sample is multiplied by four to provide an estimate of the load girth for a full revolution of rotating arm 112, the estimated load girth may be much larger than actual load girth. However, if a half sample is taken, the half sample will take the long and short sides into account, and thus, when the load girth $G_c$ from the half sample is multiplied by two to provide an estimate of the load girth for a full revolution of rotating arm 112, the estimated load girth may be more accurate. If a load is square, then a quarter sample may return as accurate a result as the half sample. Preferably, partial samples are taken when rotating arm 112 is in a steady state (e.g., neither accelerating or decelerating), which may help to improve the accuracy of the results. Additionally, the means by which relative rotation is provided between the dispenser and the load may affect the size of the sample necessary to accurately determine a relative or corresponding portion of the load girth $G_c$ for any portion of a revolution of the dispenser relative to the load. For example, the greater the speed of the relative rotation, the larger portion of the relative rotation will be required to accurately determine a relative or corresponding portion of the load girth $G_c$ corresponding to that period of relative rotation. Thus, for a rotating ring, which achieves a speed of 60 rpm, a longer or larger portion of relative rotation may be required to determine a corresponding portion of the load girth $G_c$ than a turntable, which achieves a speed of 20 rpm. Similarly, a rotating arm, which may achieve speeds of approximately 35-40 rpm, would require a portion of the relative rotation that falls in between those necessary for the rotating ring and the turntable.

It is also contemplated that load girth $G_c$ may be determined using alternative means. For example, a camera device (not shown) may be mounted so that it can view packaging material 118 as it travels toward load 104. Packaging material 118 may include a plurality of reference marks at selected intervals along its length. The reference marks may be visible to the camera device. The camera device may count the number of reference marks that pass by during one relative revolution, and multiply that value by the known distance between the reference marks to find the load girth $G_c$. The camera device may relay this information to controller 170. Additionally or alternatively, a measurement device (not shown) may be mounted so that it can shine a laser beam on packaging material 118 as it travels toward load 104. The measuring device may include a detector configured to receive a reflection of the laser beam off packaging material 118. Packaging material 118 may include reference marks, such as, for example, deformities or differently colored areas, at selected intervals along its length. The unmarked areas of packaging material 118 may reflect light differently than the marked areas, and by monitoring for changes in reflectivity, the measuring device may be able to keep count of the number of reference marks that pass by. Multiplying that number by the known distance between the reference marks may provide a value indicative of the length of packaging material 118 that has passed the measuring device. The measuring device may relay this information to controller 170.

In lieu of calculating film demand as a function of girth, the demand can be determined strictly based on movement of idle roller 134. More particularly, the demand can be determined based on a distance covered by a point on the surface of idle roller 134 during rotation, idle roller speed, and/or idle roller acceleration. In such a case, there is no coupling of rotational drive system 108 to packaging material drive system 124. Rather, there is a direct electronic coupling of packaging material dispenser system 124 to idle roller 134. This arrangement results in a substantially instantaneous response to changes in film demand. Idle roller 134 effectively maps film demand in a manner similar to a load cell. In the same manner that idle roller 134 maps film demand, idle roller 134 also maps changes in film demand and changes in load girth.

Based on the demand, controller 170 may control movement of packaging material roller 122 (e.g., distance covered by a point on the surface of packaging material roller 122, packaging material roller speed, and/or packaging material roller acceleration) by controlling the operation of packaging material drive system 124. For example, as the speed of idle roller 134 increases, controller 170 may recognize the increase as being caused by an increase in demand. Accordingly, controller 170 may increase the speed of packaging material roller 122 so that more film is dispensed to meet the increased demand. On the other hand, as the speed of idle roller 134 decreases, controller 170 may recognize the decrease as being caused by a decrease in demand. Accordingly, controller 170 may decrease the speed of packaging material roller 122 so that less film is dispensed to meet the decreased demand. The speed of idle roller 134 may include, for example, the surface speed of idle roller 134 in inches per second, or the rotational speed of idle roller 134 in revolutions per minute.

It is contemplated that controller 170 may include a follower circuit configured to help perform the above-described processes. The follower circuit may directly link packaging material drive system 124 to idle roller 134 so the speed of packaging material roller 122 follows the speed of idle roller 134. This may be achieved by using the speed of idle roller 134 to establish a speed set point for packaging material roller 122 to follow. For example, if the idle roller speed is 100 inches per second, and the payout percentage set point is 110%, the speed set point will be 110 inches per second. Controller 170 will then run packaging material roller 122 at a speed of about 110 inches per second. If idle roller speed increases or decreases, indicating that demand has increased or decreased, controller 170 will increase or decrease the packaging material roller speed in response to maintain the payout percentage set point. In this embodiment, maintenance of the payout percentage set point is not based on maintaining a ratio between packaging material drive system 124 and rotational drive system 108.

It is also contemplated that controller 170 may obtain feedback from idle roller 134, including the speed of idle roller 134, and use it in conjunction with a PID (Proportional/Integral/Derivative) type control algorithm to control the output of packaging material roller 122. In such an embodiment, the idle roller speed would establish the speed set point for the PID to modify packaging material roller output in order to make the two speeds match. For example, if the idle roller speed was 100 inches per second, and the payout percentage set point was 110%, the PID control set point would be 110 inches per second. The PID would then control the output of packaging material roller 122 such that it would try to maintain a speed of about 110 inches per second. As idle roller speed changes, the PID set point is continuously updated to match the film length and speed demand of the load.

The follower circuit and PID type control algorithm may produce similar results. For example, in either case, a change in idle roller speed will produce a change in packaging material roller speed. For example, starting with the conditions described above (i.e. idle roller speed of 100 inches per second, payout percentage set point of 110%, and packaging material roller speed of 110 inches per second), if idle roller speed then increases to 110 inches per second, controller 170 will increase packaging material roller speed to about 121 inches per second in response. If idle roller speed decreases to 90 inches per second, controller 170 will decrease packaging material roller 122 speed to about 99 inches per second in response.

Figure 5:
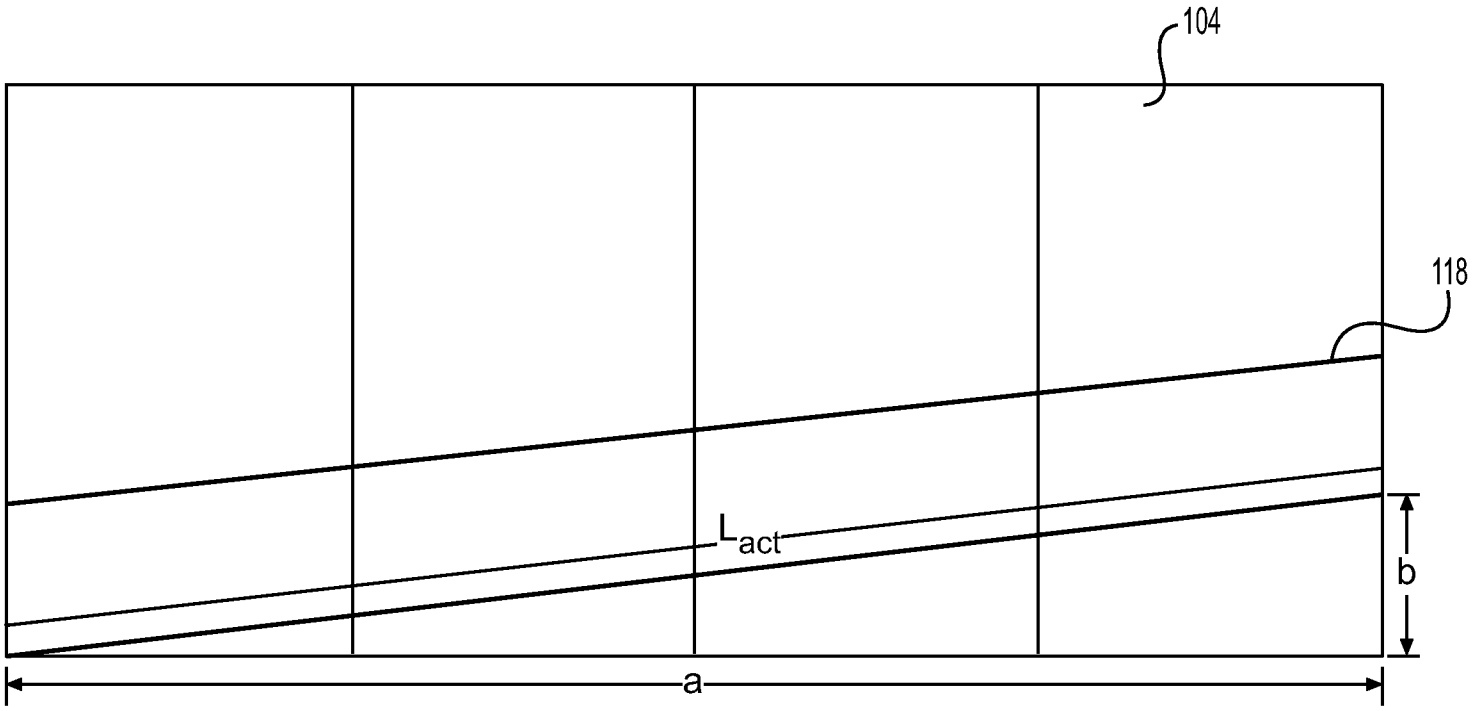
FIG. 5 shows a length of packaging material on a load, according to yet another aspect of the present disclosure.

Due to the vertical travel of packaging material dispenser 116 during the wrapping of load 104, the amount of packaging material dispensed during one revolution of packaging material dispenser 116 relative to load 104 may differ from load girth. FIG. 5 shows four sides of load 104 arranged side-by-side to represent what load 104 might look like if its vertical surfaces could be unfolded. A length of packaging material 118 indicative of that which would be applied to load 104 during one revolution of packaging material dispenser 116 relative to load 104 is also shown. The length of packaging material 118 covers a horizontal distance "a" corresponding to horizontal travel of packaging material dispenser 116 relative to load 104 provided by rotational drive system 108. The length of packaging material 118 also covers a vertical distance "b" corresponding to vertical travel of packaging material dispenser 116 relative to load 104 provided by lift drive system 148. Thus, the load girth must be compensated for the amount of vertical travel of the dispenser 116. A value "$L_{act}$" indicative of the actual length of packaging material 118 on load 104 when vertical travel of packaging material dispenser 116 occurs may be determined using the following equation:

$$L_{act}=\sqrt{(a^2+b^2}$$

The value "a" corresponds most closely to load girth. The value "b" corresponds to vertical travel of packaging material dispenser 116. If the vertical speed of packaging material dispenser 116 is increased, the value "b" becomes greater, as does $L_{act}$. This may produce error, since controller 170 performs calculations as if the packaging material does not have a vertical component "b." The amount of error may increase as "b" becomes greater.

In order to account for the error, controller 170 may calculate a value "$D_{cor}$" indicative of the demand for packaging material during a relative revolution between packaging material dispenser 116 and load 104, adjusted to account for vertical travel of packaging material dispenser 116 (either upwards or downwards) relative to load 104. $D_{cor}$ may be used in place of the value for D in the set of equations used to calculate $S_{pmr}$ described in the paragraphs above. Controller 170 may calculate $D_{cor}$ by obtaining a value $S_{\%maxlft}$ from lift drive VFD 168 that may be indicative of the vertical speed of packaging material dispenser 116 expressed as a percentage of maximum vertical speed; a value "$b_{maxlft}$" indicative of the maximum vertical distance packaging material dispenser 116 can cover during one relative revolution; $S_{\%maxrot}$; load girth G; and payout percentage P. Controller 170 may use the following equation to calculate $D_{cor}$:

$$D_{cor} = \left(\left(\sqrt{(((((V_{\%\ maxlft} \times b_{maxlft}) \div 100) \div S_{\%\ maxrot}) \times 100)^2 + G^2)}\right) \times P\right) \div 100$$

While it may be desirable to maintain the relationship between the speeds of rotational drive system 108 and packaging material drive system 124, and/or to keep the payout percentage substantially constant, for a substantial portion of a wrapping cycle, there may be portions of that wrapping cycle where it may be more desirable to make adjustments to one or more of those values. For example, exceptions may be made at the beginning portion and/or end portion of a wrapping cycle. The beginning or start-up portion of the wrapping cycle may be defined as the portion of the wrapping cycle where packaging film dispenser 116 has rotated across an arc of less than or equal to 90° relative to load 104. The end portion of the wrapping cycle may be defined as the portion of the wrapping cycle where packaging material 118 approaches its home position, such as the final 180° of rotation relative to load 104.

Prior to the start of a wrapping cycle, a tail end of packaging material 118 may be held by clamping device 180, such that packaging material 118 may extend between clamping device 180 and packaging material dispenser 116. During the start-up portion of the wrapping cycle, rotational drive system 108 may accelerate to begin providing relative rotation between packaging material dispenser 116 and load 104. Packaging material drive system 124 may also accelerate to dispense packaging material 118. During this phase, a high clamping force is required to hold the tail end of packaging material 118.

A way to reduce the clamping force required is for controller 170 to run packaging material drive system 124 substantially immediately upon start-up to dispense enough packaging material 118 so that the amount of clamping force necessary to hold the length of packaging material 118 in clamping device 180 during start-up may be reduced. In order to determine how much packaging material 118 to dispense during start-up, controller 170 may obtain a value "$R_{rot}$" indicative of the distance between an axis of rotation of rotating arm 112 and packaging material dispenser 116. This value may be preprogrammed or input by the operator. Using $R_{rot}$, controller 170 may calculate a value $C_{rot}$ indicative of the circumference of the path traveled by packaging material dispenser 116, using the following equation:

$$C_{rot}=2\pi R_{rot}$$

Controller 170 may then use $C_{rot}$ to calculate the length $L_{acel}$ of the path of travel that packaging material dispenser 116 covers during the first 90° of rotation of rotating arm 112 (i.e., during the first ¼ rotation of the arm about the load) using the following equation:

$$L_{acel}=C_{rot}/4$$

Controller 170 may instruct packaging material drive system 124 to dispense a length of packaging material substantially equivalent to the distance traveled by packaging material dispenser 116 at 90°, during the start-up portion of the wrapping cycle. This may help to ensure that little or no force is exerted on the length of packaging material 118 between packaging material dispenser 116 and clamping device 180 during start-up. Depending upon the rate of acceleration, the length of the path of travel calculated based on $C_{rot}$ may be larger or smaller and the above equation may be modified to reflect the amount of a single rotation to be completed by the arm during the start-up portion of the cycle (e.g., 90°=¼ rotation (as illustrated above), 180°=½ rotation, and 45°=⅛ rotation).

Since clamping device 180 may not remain stationary during start-up, movement of clamping device 180 may be factored in when calculating the length of packaging material 118 to dispense during start-up. For example, clamping device 180 may travel in an arc toward the side of load 104 during start-up, thus moving tail end of packaging material 118 toward packaging material dispenser 116. This movement may alleviate some of the tensile force in the length of packaging material 118 between clamping device 180 and packaging material dispenser 116. The existence of this movement may be used to modify the length of packaging material 118 dispensed at start-up so that excess packaging material 118 is not dispensed.

It is also contemplated that the length of packaging material 118 dispensed at start-up may be increased or decreased depending on other factors. For example, if clamping device 180 is replaced with a clamping device having a stronger holding force, the length of packaging material 118 dispensed during start-up can be reduced. If clamping device 180 is replaced with a clamping device having a weaker holding force, the length dispensed during start-up can be increased. Additionally or alternatively, the strength of packaging material 118 may be taken into consideration. A stronger packaging material may require dispensing of a shorter length during start-up, while a weaker packaging material may require dispensing of a longer length during start-up. Further, the geometry of clamping device 180 relative to load 104 may also affect how much of a length of packaging material 118 to dispense at start-up. For example, if clamping device 180 is overwrapped during start-up, clamping device 180 may act like a bump on load 104. The size of that bump may be affected by the distance of clamping device 180 from load 104, the shape of clamping device 180, and/or the size of clamping device 180. In order to compensate for the bump, the dispensing of additional packaging material 118 may be required during start-up to prevent excessive tensile forces from developing in packaging material 118.

After completion of the start-up portion of the wrapping cycle, the speed of rotational drive system 108 and the speed of packaging material drive system 124 may be set based on load girth and payout percentage, as described previously in the calculation of $S_{pmr}$.

It is also contemplated that during the start-up portion, the value for load girth G entered into or obtained by controller 170 may be equal to $C_{rot}$. After the start-up portion of the wrapping cycle, that value may be replaced by a value indicative of the actual girth of the load. Such methods for operating stretch-wrapping apparatus 100 during the start-up portion of a wrapping cycle are particularly robust in that they depend on fixed values (e.g., rotating arm length or packaging material dispenser path), and thus the methods may work regardless of the size of the load to be wrapped.

Additionally or alternatively, controller 170 may be programmed to instruct packaging material dispenser 116 to blindly dispense packaging material 118 for a selected length of time corresponding to the start-up portion of the wrapping cycle.

For the end portion of the wrapping cycle, testing may be used to determine a value for payout percentage that reduces or eliminates the forces on the length of packaging material 118 extending between clamping device 180 and packaging material dispenser 116. Testing has shown that during the end portion of the wrapping cycle, a payout percentage "P" of 115% produces the desired result (e.g., reduces forces, does not produce excess packaging material). Thus, controller 170 may be programmed so that during the end portion of the wrapping cycle, the payout percentage P may change from the level at which it was previously set to 115%. Using the equations provided above, controller 170 may determine the appropriate value for $S_{pmr}$ in light of the payout percentage P being set at or changed to 115%.

At the modified payout percentage, enough packaging material 118 may be dispensed so that packaging material 118 may not be damaged when it is distended by clamping device 180 during the end portion of the wrapping cycle. Additionally or alternatively, enough packaging material 118 may be dispensed so that little or no force is exerted by packaging material dispenser 116 and clamping device 180 on the length of packaging material 118 extending therebetween. The payout percentage to accomplish this may depend on several factors, including, for example, the manner and degree in which clamping device 180 distends packaging material 118 during the end portion of the wrapping cycle, the strength of packaging material 118, and the geometry of clamping device 180 (e.g., its size, shape, and/or position) relative to load 104. Once the desired payout percentage is found, and is implemented, it may help to prevent the tail of packaging material 118 from being ripped from clamping device 180, prevent packaging material 118 from being torn or severed, and prevent packaging material dispenser 116 from being pulled back towards clamping device 180 in a reverse direction. Further, by ending a wrapping cycle at the modified payout percentage, the tension in the length of packaging material 118 extending between clamping device 180 and packaging material dispenser 116 may be consistent and predictable, eliminating some of the variability associated with the start-up portion of the next wrapping cycle.

According to yet another aspect of the present disclosure, means may be provided for detecting packaging material breaks during a wrapping cycle. If a break is not detected quickly, packaging material dispenser 116 may continue to dispense packaging material 118 as if a break has not occurred, and the excess packaging material causes further malfunctions and/or damage to packaging material dispenser 116 or other parts of wrapping apparatus 100. Additionally, failing to detect a break may lead to loads leaving a wrapping station unwrapped. Once a break is detected, wrapping apparatus 100 should be re-set in a timely fashion to minimize downtime. As used herein, the term "break" is meant to describe a complete or total severing of packaging material 118, that is, a cutting or tearing across the entire width of packaging material 118 that splits the packaging material 118 into separate pieces. The term "break" is not meant to refer to a relatively small puncture, rip, or tear in packaging material 118 that may be carried through onto load 104 during wrapping. However, if the relatively small puncture, rip, or tear in packaging material 118 stretches to the point that it completely severs packaging material 118 before making its way onto load 104, then the relatively small puncture, rip, or tear will have become a break.

It is known to detect packaging material breaks using a load cell to measure forces on the packaging material, and to signal that a break has occurred when the force falls outside of a range of acceptable values. However, use of load cells may be undesirable since they require calibration, may malfunction due to noise caused by other electronic devices, and may increase the overall complexity and cost of wrapping apparatuses. Further, because wrapping apparatus 100 may dispense a selected length of packaging material 118 during revolutions of packaging material dispenser 116 relative to load 104, there is a low level of force on the length of packaging material extending between packaging material dispenser 116 and load 104. It is difficult for load cells to discern when packaging material breaks occur under low-force conditions. Furthermore, load cells typically introduce a delay between the time when a break is sensed and when action is taken in response to the break, and that delay may be undesirable when seeking to quickly detect breaks and take actions in response.

According to an aspect of the present disclosure, controller 170 may monitor the rotation of idle roller 134 using sensor assembly 136 to detect when a break has occurred in the packaging material during a wrapping cycle. The premise is that if the number of pulses detected by sensor assembly 136 is less than the expected number of pulses, controller 170 may recognize that a break has occurred.

One way of accomplishing break detection is to compare the actual time between pulses to the expected time between pulses. Controller 170 may obtain a value "$T_{act}$" indicative of the actual time between pulses using sensor assembly 136 and any suitable timing mechanism (not shown), such as, for example, a stopwatch or internal clock in controller 170. Controller 170 may also obtain a value "$S_{rpm}$" indicative of the speed of rotating arm 112 in revolutions per minute using sensor assembly 136 and the timing mechanism. Controller 170 may calculate a value "$S_{spr}$" indicative of the speed of rotating arm 112 in seconds per revolution using the following equation:

$$S_{spr}=(60\div S_{rpm})$$

Controller 170 may obtain load girth G, which may be programmed into controller 170, entered using operator interface 176, or determined using idle roller 134 in the manner described in the paragraphs above. Controller may also obtain "$C_{ir}$," which is indicative of the circumference of idle roller 134, and $N_{ir}$, which is indicative of the number of transducers on idle roller 134. Using these values, controller 170 may calculate a value "$T_{exp}$" indicative of the expected time between pulses using the following equation:

$$T_{exp}=S_{spr}\div((G\div C_{ir})\times N_{ir})$$

Controller 170 may then obtain a value "F." The value F may be indicative of the number of times that the actual time between pulses must be longer than the expected time between pulses before controller 170 determines that a break has occurred. Thus, controller 170 may recognize that a break has occurred when the following relationship is satisfied:

$$T_{act}>F\times T_{exp}$$

If break detection is carried out by comparing the actual time between pulses to the expected time between pulses using the equations above, the value for F may be selectively adjusted to control the sensitivity of control system 160. Increasing F makes controller 170 less sensitive, since longer delays between pulses may be tolerated without triggering controller 170. On the other hand, decreasing F makes controller 170 more sensitive, since the length of tolerable delay between pulses may decrease, thus triggering controller 170 more quickly.

When a break is detected, controller 170 may instruct packaging material drive VFD 166 to stop packaging material drive system 124, thus halting the dispensing of packaging material from packaging material dispenser 116.

Alternatively, controller 170 may be programmed such that any missed pulse is recognized as a packaging material break. If that produces too many false positives, controller 170 may be programmed such that two missed pulses in a row will be recognized as a packaging material break. The number of missed pulses that will signify a packaging material break may be selectively adjusted depending on the level of sensitivity that is desired.

During the start-up and/or end portions of the wrapping cycle, the value for F, or the number of missed pulses necessary to signify a break, may be increased to account for changes in operation during those portions of the wrapping cycle. For example, if two missed pulses will be recognized as a packaging material break during an intermediate portion of the wrapping cycle (i.e., after start-up but before end), five missed pulses may be required before a packaging material break will be recognized during the start-up and/or end portions.

Breakage of film may change the direction of rotation of idle roller 134, due, for example, to recovery of the film after breakage or backlash of the broken film, a change in the direction of rotation may be an indicator of breakage. Thus, regardless of the number of missed pulses, controller 170 may recognize that a break has occurred if the direction of rotation of idle roller 134 reverses. The direction of rotation of idle roller 124 may be monitored by sensor assembly 136, which may include, for example, an encoder.

According to yet another aspect of the disclosure, means may be provided for determining a number of loads that can be wrapped using roll 130 of packaging material 118 in packaging material dispenser 116. One way of making this determination is to first determine how much packaging material 118 there is on a new full roll of packaging material 118. This may be accomplished by loading the new full roll into packaging material dispenser 116, and wrapping loads until the roll becomes empty, while keeping track of the length of packaging material 118 dispensed as the roll goes from full to empty. The length may be tracked using the aforementioned camera device, the laser measuring device, and/or any other suitable packaging material length measuring means.

Additionally or alternatively, control system 160 may be used to measure the length of packaging material 118 on roll 130. For example, controller 170 may determine a value "$N_{pmr}$," which may be indicative of the number of pulses generated at sensor assembly 128 as the roll goes from full to empty. A value "$T_{pmr}$," which may be indicative of the number of transducers 138 mounted on packaging material roller 122, may be programmed into controller 170, or entered using operator interface 176. Using the following equation, controller 170 may calculate a value "$Y_{pmr}$" indicative of the number of revolutions undergone by packaging material roller 122 as the roller of packaging material is consumed:

$$Y_{pmr}=N_{pmr}\div T_{pmr}$$

By obtaining a value "$C_{pmr}$," indicative of a circumference of packaging material roller 122, through information entered at operator interface 176 or by any other means, controller 170 may calculate a value "$L_{roll}$" indicative of the length of packaging material 118 dispensed when a new roll is consumed. The length $L_{roll}$ may be found using the following equation:

$$L_{roll}=Y_{pmr}\times C_{pmr}$$

Once $L_{roll}$ is found, it may be assumed that each subsequent replacement roller may hold the same length of film, since rolls of film may be substantially the same.

When another roll is subsequently inserted, controller 170 may count the number of pulses generated at sensor assembly 128 as packaging material roller 122 rotates while wrapping is performed. Using that number, $T_{pmr}$, $C_{pmr}$, and the steps and equations set forth above, controller 170 may calculate a value "$L_{used}$" indicative of the length of packaging material 118 consumed. By subtracting $L_{used}$ from $L_{roll}$, controller 170 may calculate a value "$L_{rem}$" indicative of the length of packaging material 118 remaining on the roll.

Controller 170 may also count the number of pulses generated at sensor assembly 128 for each wrapped load. Using that number, $T_{pmr}$, $C_{pmr}$, and the steps and equations set forth above, controller 170 can calculate a value "$L_{pre}$" indicative of the length of packaging material 118 dispensed during the wrapping of a previous load. Controller 170 may divide $L_{rem}$ by $L_{pre}$ to find the number of loads that can still be wrapped using the current roll. For example, if the length $L_{pre}$ dispensed was 100 inches, and $L_{rem}$ is 450 inches, controller 170 may calculate the number of loads that can be wrapped with the current roll by dividing 450 inches by 100 inches to get a value of 4.5. This means that about four and a half loads similar to the previously wrapped load may be wrapped before the current roll is empty. Since wrapping a load halfway may be undesirable, controller 170 may round down to the nearest whole number, in this example four. Thus, controller 170 may recognize that four loads can be fully wrapped with the current roll. Knowing this, controller 170 may signal an operator to let the operator know that the current roll should be replaced using, for example, operator interface 176, before the current roll actually becomes empty. For example, controller 170 may signal the operator prior to the wrapping of the first, second, third, or fourth load, going by the above example. Thus, the operator may be prepared to replace the roll when the roll is empty, or near empty, helping to minimize machine downtime. It should be understood that the time at which controller 170 warns the operator of a need for a roll change may be set at a threshold value such that, when the number of loads that can be wrapped using the current roller falls to the threshold value, the operator may be alerted. The threshold value may be increased or decreased depending on the length of time it takes for the operator to respond. It is also contemplated that the number of loads that can be wrapped using the current roll may be displayed on operator interface 176 frequently, so that the operator may be able to determine when a new roller may be required while walking by operator interface 176 and performing a visual inspection of the displayed data. Alternatively, or additionally, the controller may display a running count of the number of loads to be wrapped until roll change (similar to number of miles to travel before out of gas on a car dashboard display).

Figure 3:
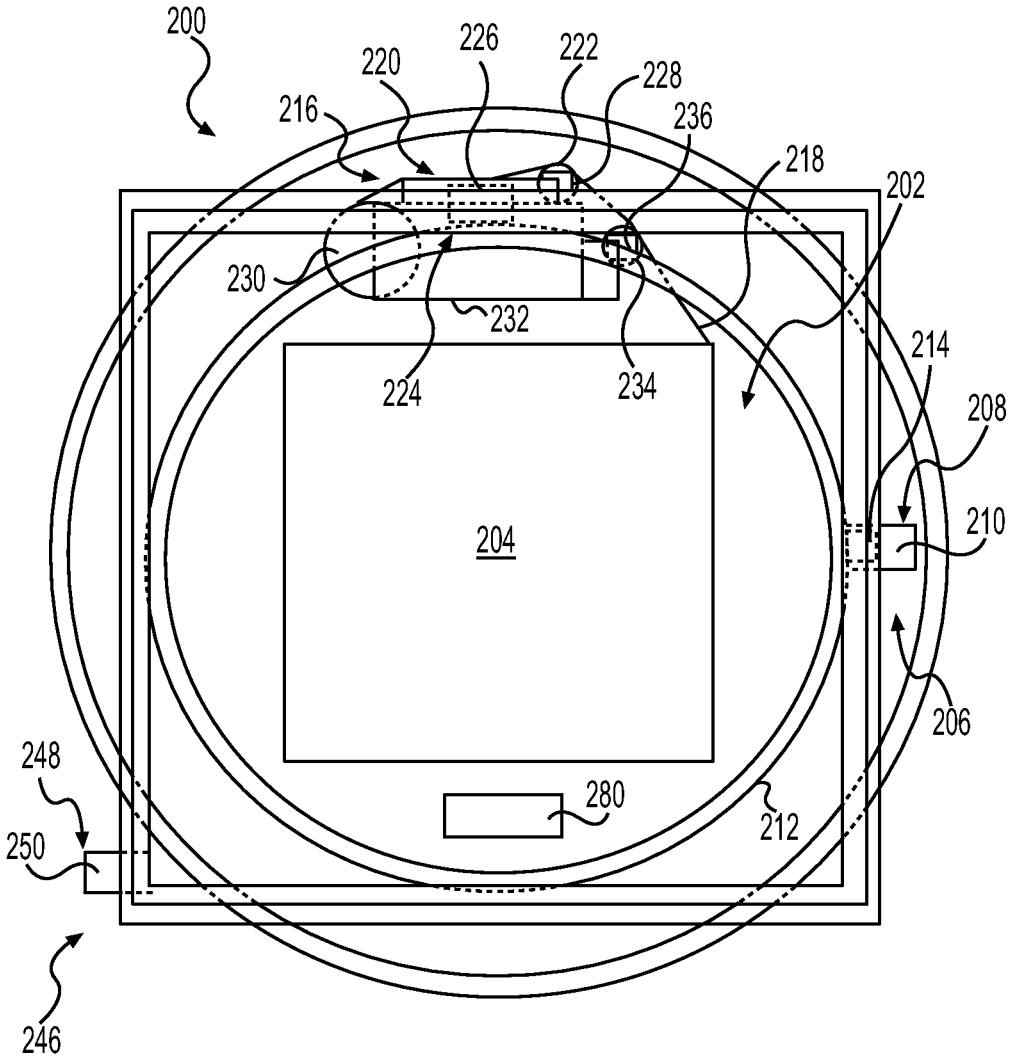
FIG. 3 shows a top view of a second exemplary wrapping apparatus according to another aspect of the present disclosure.

FIG. 3 shows a wrapping apparatus 200 of the rotating ring variety. Wrapping apparatus 200 may include elements similar to those shown in relation to wrapping apparatus 200, and similar elements may be represented with similar reference numerals. As shown, wrapping apparatus 200 includes a rotating ring 212 in place of rotating arm 112 of wrapping apparatus 100. However, it should be understood that wrapping apparatus 200 may operate in a manner similar to that described above.

Figure 4:
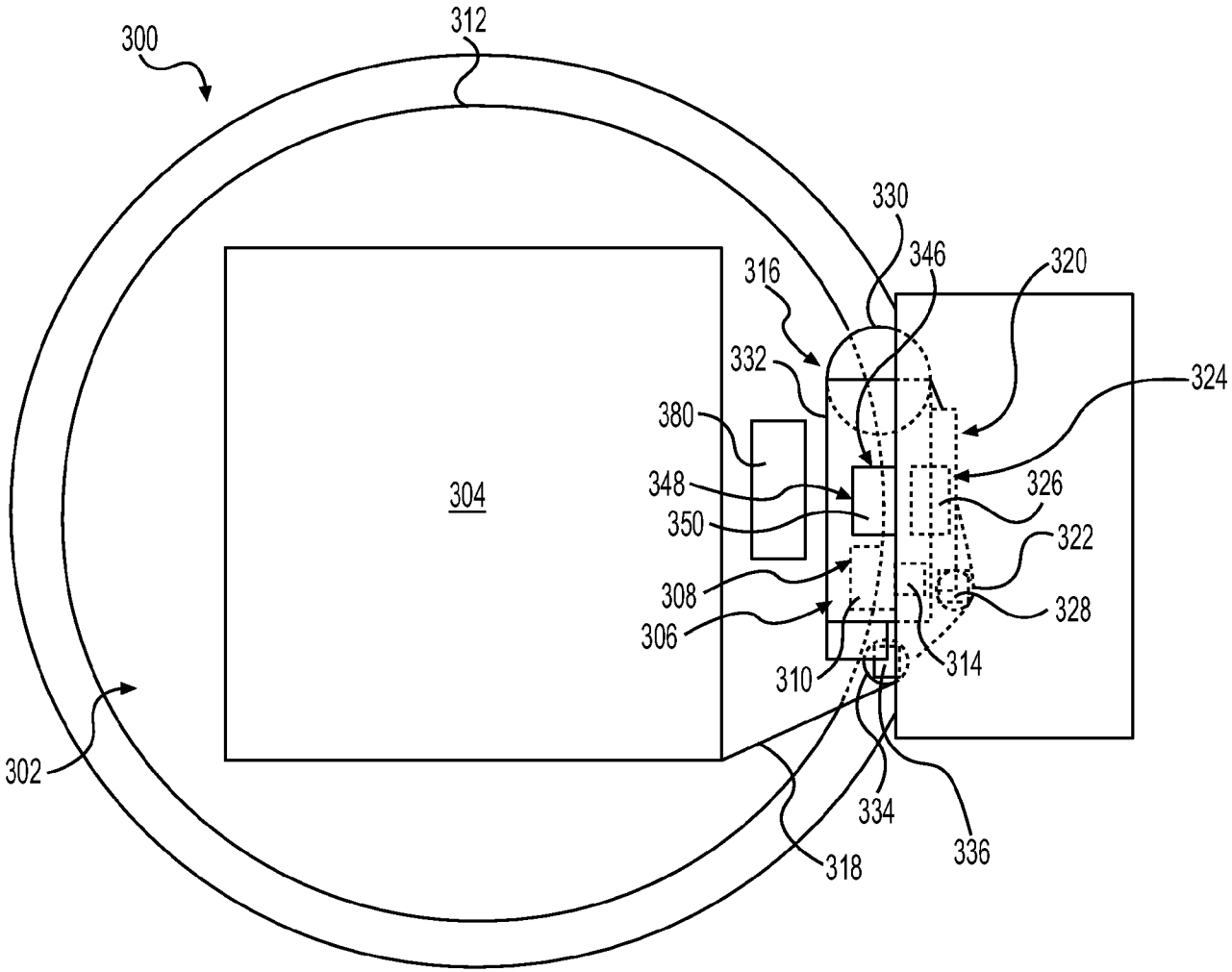
FIG. 4 shows a top view of a third exemplary wrapping apparatus according to yet another aspect of the present disclosure.

FIG. 4 shows a wrapping apparatus 300 of the rotating turntable variety. Wrapping apparatus 300 may include elements similar to those shown in relation to wrapping apparatus 300, and similar elements may be represented with similar reference numerals. As shown, wrapping apparatus 300 includes a rotating turntable 312 for rotating load 304 while packaging material dispenser 316 remains fixed, in place of rotating arm 112 of wrapping apparatus 100. However, it should be understood that wrapping apparatus 300 may operate in a manner similar to that described above.

An exemplary method for wrapping a load will now be described. Reference will be made to elements in FIGS. 1 and 2.

Initially, packaging material dispenser 116 may be in its home position, that is, proximate clamping device 180 shown in FIG. 1. Packaging material 118 may extend from packaging material dispenser 116 toward clamping device 180. Clamping device 180 may grip a leading end of packaging material 118. Load 104 may be placed on wrapping surface 102. Load 104 may be placed on wrapping surface 102 by a pallet truck (not shown), may be conveyed onto wrapping surface 102 using a conveying means (i.e., rollers or a conveying belt; not shown), or may be built on wrapping surface 102 by stacking or arranging a number of items thereon.

If the girth G of load 104 is known, it may be obtained or entered into controller 170. The load girth G may be measured using a measuring tape, or using one or more sensing devices configured to recognize the location of corners, edges, or surfaces of the load. If the girth G is not known, it may be measured after the wrapping cycle has begun using steps that will be described in greater detail below.

The payout percentage P may be obtained by or entered into controller 170. The payout percentage P may be selected based on the desired wrap force. The desired wrap force may be obtained by, for example, looking at historical performance data to identify a wrap force that has successfully prevented shifting of loads similar to load 104 during shipping.

With load 104 in place, controller 170 may enter the start-up phase of a wrapping cycle. During the start-up phase, packaging material dispenser 116 may undergo rapid acceleration. Controller 170 may run packaging material drive system 124 substantially immediately upon start-up to dispense enough packaging material 118 to reduce the clamping force required by clamping device 180 during start-up. Controller 170 may determine how much packaging material 118 to dispense during start-up by performing a number of calculations. Controller 170 may obtain the distance $R_{rot}$ between an axis of rotation of rotating arm 112 and packaging material dispenser 116. This value may be preprogrammed or input by the operator. Controller 170 may calculate the circumference $C_{rot}$ of the path traveled by packaging material dispenser 116 using the equation: $C_{rot}=2\pi R_{rot}$. Controller 170 may use $C_{rot}$ to calculate the length $L_{acel}$ of the path of travel that packaging material dispenser 116 covers during the start-up phase (e.g., the first 90° of rotation of rotating arm 112 or the first quarter of a rotation of the rotating arm 112) using the equation: $L_{acel}=C_{rot}/4$. Controller 170 may instruct packaging material drive system 124 to dispense a length of packaging material 118 substantially equivalent to the length traveled by packaging material dispenser 116 during the start-up phase.

After the start-up phase of the wrapping cycle, controller 170 may make adjustments to the operational settings of wrapping apparatus 100 so that load 104 may be properly wrapped during an intermediate phase of the wrapping cycle that follows the start-up phase. The adjustments may be made to set the operational settings equal to values obtained or calculated by controller 170. The values may be obtained or calculated prior to or during the wrapping cycle. An exemplary embodiment of the calculations will now be described.

If the girth G was known prior to the start of the wrapping cycle, controller 170 may calculate the film demand D using the following equation: $D=G\times(P\div100)$. Controller 170 may obtain or be provided with the circumference $C_{pmr}$ of packaging material roller 122, and may calculate the number of revolutions $N_{prr}$ packaging material roller 122 must undergo per one revolution of packaging material dispenser 116 relative to load 104 to meet the demand D using the following equation: $N_{prr}=D\div C_{pmr}$. Controller 170 may obtain or calculate the speed $S_{rot}$ of rotational drive system 108 in revolutions per minute. Controller may calculate $S_{rot}$ by obtaining, using rotational drive VFD 164, the speed $S_{\%maxrot}$ of rotational drive system 108 expressed as a percentage of the maximum speed of rotational drive system 108. The maximum speed $S_{maxrot}$ of rotating arm 112 in revolutions per minute may be determined by calibrating rotational drive system 108 and rotational drive VFD 164 prior to starting the wrapping cycle. Using these values, controller may calculate $S_{rot}$ using the following equation: $S_{rot}=(S_{\%max\ rot}\div100)\times S_{max\ rot}$. Controller may use the number of revolutions required of packaging material roller 122 represented by value $N_{prr}$ and $S_{rot}$ to calculate the necessary speed $S_{pmr}$ of packaging material roller 122 (in revolutions per minute) to achieve the desired number of rotations $N_{prr}$ of packaging material roller 122 during relative rotation using the following equation: $S_{pmr}=N_{prr}\times S_{rot}$.

Controller 170 may set packaging material drive system 124 so that it operates at $S_{pmr}$ using packaging material drive VFD 166. For example, controller 170 may use $S_{pmr}$, and the maximum speed $S_{maxpmr}$ of packaging material roller 122 (i.e., the speed of packaging material roller 122 in revolutions per minute with packaging material drive system at maximum speed) to calculate the speed $S_{\%maxpmr}$ of packaging material drive system 124 expressed as a percentage of the maximum speed of packaging material roller 122 using the following equation: $S_{\%max\ pmr}=(S_{pmr}\div S_{max\ pmr})\times100$. The maximum speed $S_{maxpmr}$ of packaging material drive system 124 in revolutions per minute may be determined by calibrating packaging material drive system 124 and packaging material drive VFD 166 prior to the start of the wrapping cycle. Controller 170 may instruct packaging material drive VFD 166 to run electric motor 126 so that packaging material roller 122 rotates at the rate corresponding to $S_{\%maxpmr}$ during the intermediate phase of the wrapping cycle, as packaging material dispenser 116 rotates relative to load 104 to wrap load 104.

If, during this phase of the wrapping cycle, any of the values obtained or calculated above changes, controller 170 may make further adjustments to the operational settings. Controller 170 may accomplish this by continually calculating updated values using the equations above, and adjusting the speed of electric motor 126 accordingly in order to maintain the relationship between rotational drive speed and packaging material drive speed as wrapping of load 104 is being performed.

If, however, the load girth G was not known prior to the start of the wrapping cycle, controller 170 may calculate the load girth G during the wrapping cycle using control system 160. Idle roller 134 may rotate as packaging material 118 from packaging material roller 122 engages idle roller 134 while on its way to load 104. As idle roller 134 rotates, one or more transducers 142 mounted on idle roller 134 may come into and out of range of sensing device 144. Each time one or more transducers 142 comes into range of sensing device 144, a pulse may be produced by sensing device 136. Controller 170 may monitor the number, frequency, and timing of the pulses. Since controller 170 may also monitor the revolutions of rotating arm 112 using sensor assembly 114, controller 170 may have the ability to determine the number of pulses $N_{ir}$ of idle roller 134 per one revolution of rotating arm 112. The number of transducers 142 T mounted on idle roller 134 may have already been programmed into controller 170. Using the following equation, controller 170 may calculate the number of revolutions of idle roller 134 per revolution of rotating arm 112, Y: $Y=N_{ir}\div T$. Upon obtaining the circumference $C_{ir}$ of idle roller 134, controller 170 may calculate the load girth $G_c$ using the following equation: $G_c=Y\times C_{ir}$. The value $G_c$ may be used as the load girth G by controller 170 to calculate the desired speed $S_{pmr}$ of packaging material roller 122.

Further, it is contemplated that even if the load girth G was known prior to start-up of the wrapping cycle, if the load girth G changes during the wrapping cycle, controller 170 may use $G_c$ to calculate a new $S_{pmr}$ so that the relationship between the speeds of rotational drive system 108 and packaging material drive system 124 may be continuously updated during the intermediate phase of the wrapping cycle to account for any changes.

During at least a portion of the intermediate phase of the wrapping cycle (e.g., between the start-up phase and the end phase), packaging material dispenser 116 will be driven not only rotationally relative to load 104, but also vertically relative to load 104, so that packaging material 118 will be wrapped spirally about load 104. As shown in FIG. 5, the amount of packaging material 118 dispensed during one revolution of packaging material dispenser 116 relative to load 104 may differ from the load girth G due to the vertical travel of packaging material dispenser 116. Thus, the load girth G must be compensated for the amount of vertical travel of the dispenser 116. The actual length $L_{act}$ of packaging material 118 on load 104 when vertical travel of packaging material dispenser 116 occurs may be determined using the following equation: $L_{act}=\sqrt{(a^2+b^2)}$. The value "a" corresponds most closely to the load girth G. The value "b" corresponds to vertical travel of packaging material dispenser 116. In order to account for the error caused by the vertical travel, controller 170 may calculate the demand $D_{cor}$ for packaging material during a relative revolution between packaging material dispenser 116 and load 104, adjusted to account for the vertical travel of packaging material dispenser 116 (either upwards or downwards) relative to load 104. $D_{cor}$ may be used in place of the value for D in the set of equations used to calculate $S_{pmr}$ described in the paragraphs above. Controller 170 may calculate $D_{cor}$ by obtaining from lift drive VFD 168 the vertical speed $S_{\%maxlft}$ of packaging material dispenser 116 expressed as a percentage of maximum vertical speed; the maximum vertical distance $b_{maxlft}$ packaging material dispenser 116 can cover during one relative revolution; $S_{\%maxrot}$; load girth G; and payout percentage P. Controller 170 may use the following equation to calculate $D_{cor}$:

$$D_{cor} = \left(\left(\sqrt{(((((V_{\%\,maxlft}\times b_{maxlft})\div 100)\div S_{\%\,maxrot})\times 100)^2+G^2)}\right)\times P\right)\div 100.$$

Such calculations and determinations may be carried out before or during the intermediate phase of the wrapping cycle, as packaging material dispenser 116 wraps packaging material 118 spirally about load 104.

During the start-up and intermediate phases of the wrapping cycle, packaging material dispenser 116 may wrap one or more layers of packaging material 118 around a bottom portion of load 104, a top portion of a pallet (not shown) supporting load 104, the sides of load 104, and a top portion of load 104. With load 104 substantially wrapped, packaging material dispenser 116 may proceed back towards its home position proximate clamping device 180 in FIG. 1. The last 180° of rotation of packaging material dispenser 116 during a wrap cycle comprises the end portion of the wrapping cycle. As packaging material dispenser 116 moves into the home position, clamping device 180 grasps the length of packaging material 118 extending between load 104 and packaging material dispenser 116, distending packaging material 118 in this path. During the end portion, a selected value for the payout percentage P that reduces the clamping force that clamping device 180 is required to exert on the tail end of packaging material 118 to hold it properly, may be entered into and used by controller 170. For example, a payout percentage P of 115% may help accomplish the desired result. Using the equations provided above, controller 170 may determine the appropriate value for $S_{pmr}$ in light of the payout percentage P being set at or changed to 115%. With packaging material dispenser 116 in its home position, the wrapping cycle ends. Newly wrapped load 104 may be conveyed or otherwise removed from wrapping surface 102 to make room for a subsequent load.

During the start-up phase, intermediate phase, and/or end phase of the wrapping cycle, controller 170 may monitor the rotation of idle roller 134 using sensor assembly 136 to detect when a break has occurred in packaging material 118. If the number of pulses detected by sensor assembly 136 is less than the number of pulses expected during any of the phases of the wrapping cycle, controller 170 may recognize that a break has occurred. Controller 170 may accomplish break detection by comparing the actual time between pulses to the expected time between pulses. Controller 170 may obtain the actual time $T_{act}$ between pulses using sensor assembly 136 and any suitable timing mechanism (not shown). Controller 170 may also obtain the speed $S_{rpm}$ of rotating arm 112 in revolutions per minute using sensor assembly 136 and the timing mechanism. Controller 170 may calculate the speed $S_{spr}$ of rotating arm 112 in seconds per revolution using the following equation: $S_{spr}=(60\div S_{rpm})$. Controller 170 may obtain the load girth G, which may be programmed into controller 170, entered using operator interface 176, or determined using idle roller 134 in the manner described in the paragraphs above. Controller 170 may also obtain the circumference $C_{ir}$ of idle roller 134 and $N_{ir}$, the number of transducers on idle roller 134. Using these values, controller 170 may calculate the expected time $T_{exp}$ between pulses using the following equation: $T_{exp}=S_{spr}\div((G\div C_{ir})\times N_{ir})$. Controller 170 may then obtain the number of times F that the actual time between pulses must be longer than the expected time between pulses before controller 170 determines that a break has occurred. Thus, controller 170 may recognize that a break has occurred when the following relationship is satisfied: $T_{act}>F\times T_{exp}$. Additionally or alternatively, controller 170 may recognize the break if the direction of rotation of idle roller 134 reverses. When a break is detected, controller 170 may instruct packaging material drive VFD 166 to stop packaging material drive system 124, thus halting the dispensing of packaging material from packaging material dispenser 116 and ending or pausing the wrapping cycle. Controller 170 may generate an audio and/or visual alert, or any other suitable signal, notifying an operator that a break has occurred. The operator may rectify the situation, and may re-start the wrapping cycle.

Another exemplary method for wrapping a load will now be described. Reference will be made to elements in FIGS. 1 and 2.

Initially, packaging material dispenser 116, clamping device 180, packaging material 118, packaging material dispenser 116, load 104, and wrapping surface 102 may be arranged in the same way they are initially arranged in the method described above.

The speed of rotational drive system 108 and a desired payout percentage P may be obtained or entered into controller 170. The payout percentage P may be selected based on the desired wrap force. The desired wrap force may be obtained by, for example, looking at historical performance data to identify a wrap force that has successfully prevented shifting of loads similar to load 104 during shipping.

With load 104 in place, controller 170 may enter the start-up phase of a wrapping cycle. The start-up phase may be similar to the start-up phase of the method described above. After the start-up phase of the wrapping cycle, controller 170 may make adjustments to the operational settings of wrapping apparatus 100 so that load 104 may be properly wrapped during an intermediate phase of the wrapping cycle that follows the start-up phase. The adjustments may be made to set the operational settings equal to values obtained or calculated by controller 170.

During the intermediate phase, controller 170 may use the speed of idle roller 134 to determine the demand, and based on the demand, controller 170 may select or adjust the speed of packaging material roller 122 by controlling packaging material drive system 124.

For example, in one embodiment, controller 170 may include a follower circuit that links packaging material drive system 124 to idle roller 134. The speed of idle roller 134 may be used to establish a speed set point for packaging material roller 122 to follow. If idle roller speed increases or decreases, indicating that demand has increased or decreased, controller 170 will increase or decrease the packaging material roller speed in response to maintain the desired payout percentage throughout the entire intermediate phase of the wrapping cycle.

Additionally or alternatively, controller 170 may obtain feedback from idle roller 134, including the speed of idle roller 134, and use it in conjunction with a PID (Proportional/Integral/Derivative) type control algorithm to control the output of packaging material roller 122. In such an embodiment, the idle roller speed would establish the speed set point for the PID to modify packaging material roller output in order to make the two speeds match. As idle roller speed changes, indicating that demand has changed, the PID set point is continuously updated to match the film length and speed demand of the load. This may also help controller 170 maintain the desired payout percentage.

If, during this phase of the wrapping cycle, any of the values obtained or calculated above changes, controller 170 may make further adjustments to the operational settings. Controller 170 may accomplish this by continually calculating updated values using the equations above, and adjusting the speed of electric motor 126 accordingly in order to maintain the relationship between rotational drive speed and idle roller speed.

During the start-up and intermediate phases of the wrapping cycle, packaging material dispenser 116 may wrap one or more layers of packaging material 118 around a bottom portion of load 104, a top portion of a pallet (not shown) supporting load 104, the sides of load 104, and a top portion of load 104. With load 104 substantially wrapped, packaging material dispenser 116 may proceed back towards its home position proximate clamping device 180 in FIG. 1. The movement of packaging material dispenser 116 through the last 180° of rotation during a wrapping cycle comprises the end portion of the wrapping cycle. The end portion may be similar to the end portion described in the method above. After packaging material dispenser 116 reaches its home position, the wrapping cycle ends. Newly wrapped load 104 may be conveyed or otherwise removed from wrapping surface 102 to make room for a subsequent load.

During the start-up phase, intermediate phase, and/or end phase of the wrapping cycle, controller 170 may monitor the rotation of idle roller 134 using sensor assembly 136 to detect when a break has occurred in packaging material 118. The manner of detecting when a break has occurred, and the steps taken in response, may be similar to the way breaks are detected and responded to in the method described above.

Each of the elements and methods described in the present disclosure may be used in any suitable combination with the other described elements and methods.

Other embodiments will be apparent to those skilled in the art from consideration of the specification and practice of the present disclosure. It is intended that the specification and examples be considered as exemplary only, with a true scope and spirit of the disclosure being indicated by the following claims.

What is claimed is:

1. An apparatus for wrapping a load, comprising:

a film dispenser for dispensing a film web, wherein the film dispenser is driven by a film dispensing drive configured to rotate at least one film dispenser roller of the film dispenser;

a rotational drive system for providing relative rotation between the load and the dispenser;

a sensor sensing a parameter related to demand for the film web at the load; and a controller determining demand in response to the sensed parameter, operatively coupling the film dispensing drive and the rotational drive system, and establishing a ratio between operation of the film dispensing drive and the rotational drive system such that, for at least a portion of a relative revolution between the film dispenser and the load, the film dispenser dispenses a length of the film web based on the determined demand for the film web at the load during the at least a portion of a relative revolution.

2. The apparatus of claim 1, wherein the controller is configured to operatively couple by simulating a connection between the film dispensing drive and the rotational drive system.

3. The apparatus of claim 1, wherein the demand corresponds to a length of the load traversed by the film dispenser during the at least a portion of a relative revolution.

4. The apparatus of claim 1, wherein the at least a portion of a relative revolution includes a full relative revolution, and the demand is based, at least in part, on a girth of the load.

5. The apparatus of claim 1, further comprising a first variable frequency drive for controlling the film dispensing drive.

6. The apparatus of claim 5, further comprising a second variable frequency drive for controlling the rotational drive system.

7. The apparatus of claim 6, wherein the controller is configured to simulate a connection between the first and second variable frequency drives.

8. The apparatus of claim 1, wherein the sensor comprises an idle roller.

9. The apparatus of claim 8, wherein the idle roller is downstream of the film dispenser.

10. The apparatus of claim 8, wherein the controller is configured to identify demand based, at least in part, on rotation of the idle roller.

11. The apparatus of claim 8, wherein the idle roller is configured to respond to a change in demand.

12. The apparatus of claim 11, wherein the controller is configured to vary the length of the film web dispensed based on the response of the idle roller to the change in demand.

13. The apparatus of claim 8, wherein the controller is configured to identify a film break based on a speed or direction of rotation of the idle roller.

14. The apparatus of claim 8, wherein the controller is configured to:

compare an actual speed of the idle roller to an expected speed of the idle roller; and stop the rotational drive system if the actual speed differs from the expected speed by a threshold amount.

15. The apparatus of claim 1, wherein the controller is configured to operate the dispensing drive and the rotational drive system at a first ratio during a first portion of a wrapping cycle, and at a second ratio during a second portion of the wrapping cycle.

16. The apparatus of claim 15, wherein the controller is configured to operate the dispensing drive and the rotational drive system at a third ratio during a third portion of the wrapping cycle, wherein at least one of the first, second, and third ratios is different from the others of the first, second, and third ratios.

17. The apparatus of claim 16, wherein the first portion is a start-up portion of the wrapping cycle, the second portion is a primary portion of the wrapping cycle, and the third portion is an end portion of the wrapping cycle.

18. An apparatus for wrapping a load, comprising:

a film dispenser for dispensing a film web, wherein the dispenser is driven by a film dispensing drive configured to rotate at least one film dispenser roller of the film dispenser;

a rotational drive system for providing relative rotation between the load and the dispenser; and a controller:

setting a length of the film web to be dispensed for at least a portion of a relative revolution between the dispenser and the load based on demand for the film web at the load;

driving the rotational drive system and the dispensing drive at a ratio at which the dispenser dispenses the set length of the film web for the at least a portion of a relative revolution;

further comprising an idle roller; and, wherein the demand is identified based at least in part on rotation of the idle roller.

19. The apparatus of claim 18, wherein the demand for the film web at the load is based at least in part on a length of the load traversed by the film dispenser during the at least a portion of a relative revolution.

20. The apparatus of claim 18, wherein the at least a portion of a relative revolution includes a full relative revolution, and the demand for the film web at the load is based at least in part on a girth of the load.

21. The apparatus of claim 18, further comprising a first variable frequency drive for controlling the film dispensing drive.

22. The apparatus of claim 21, further comprising a second variable frequency drive for controlling the rotational drive system.

23. The apparatus of claim 22, wherein the controller is configured to simulate a connection between the first and second variable frequency drives.

24. The apparatus of claim 18, wherein the idle roller is positioned downstream of the film dispenser.

25. The apparatus of claim 18, wherein the idle roller is configured to respond to a change in demand.

26. The apparatus of claim 25, wherein the controller is configured to identify the change in the demand based on the response of the idle roller to the change in demand.

27. The apparatus of claim 18, wherein the controller is configured to identify a film break based on rotation of the idle roller.

28. The apparatus of claim 18, wherein the controller is configured to:

compare an actual speed of the idle roller to an expected speed of the idle roller; and stop the rotational drive system if the actual speed differs from the expected speed by a selected amount.

29. The apparatus of claim 18, wherein the ratio at which the controller is configured to drive the rotational drive system and the dispensing drive that will result in the dispenser dispensing the set length of the film web is a first ratio, and wherein the controller is also configured to operate the dispensing drive and the rotational drive system at a second ratio.

30. The apparatus of claim 29, wherein the controller is configured to operate the dispensing drive and the rotational drive system at a third ratio, wherein at least one of the first, second, and third ratios is different from the others of the first, second, and third ratios.

31. The apparatus of claim 30, wherein the controller is configured to operate the dispensing drive and the rotational drive system at the first ratio during a primary portion of a wrapping cycle, at the second ratio during a start-up portion of the wrapping cycle, and at the third ratio during an end portion of the wrapping cycle.

32. An apparatus for wrapping film around a load, the apparatus comprising:

a film dispenser configured to dispense film to be applied to the load, wherein the film dispenser is driven by a film dispensing drive configured to rotate at least one film dispenser roller of the film dispenser;

a rotation assembly configured to provide relative rotation between the film dispenser and the load, the rotation assembly including a rotational drive;

a sensor sensing a parameter related to demand for the film web at the load; and a control system determining demand in response to the sensed parameter and electronically controlling the operation of one of the film dispensing drive or the rotational drive based at least in part on the operation of the other of the film dispensing drive or the rotational drive to dispense a length of film based on the determined demand for the film at the load.

33. The apparatus of claim 32, wherein the control system is configured to electronically control the operation by electronically coupling the film dispensing drive and the rotational drive system such that, for at least a portion of a relative revolution between the film dispenser and the load, the film dispenser dispenses the length of film based at least in part on the demand for film at the load during the at least a portion of the relative revolution.

34. The apparatus of claim 33, wherein the demand is based at least in part on a length of the load traversed during the at least a portion of a relative revolution between the film dispenser and the load.

35. The apparatus of claim 33, wherein the at least a portion of a relative revolution includes a full relative revolution between the film dispenser and the load, and wherein the demand is based at least in part on a girth of the load.

36. The apparatus of claim 32, further comprising a first variable frequency drive for controlling the film dispensing drive.

37. The apparatus of claim 36, further comprising a second variable frequency drive for controlling the rotational drive.

38. The apparatus of claim 37, wherein the control system is configured to electronically control the operation by simulating a connection between the first and second variable frequency drives.

39. The apparatus of claim 32, wherein the sensor comprises an idle roller.

40. The apparatus of claim 39, wherein the idle roller is downstream of the film dispenser roller.

41. The apparatus of claim 39, wherein the demand is based at least in part on rotation of the idle roller.

42. The apparatus of claim 39, wherein the idle roller is configured to respond to a change in demand.

43. The apparatus of claim 39, wherein the control system is configured to vary the length of film dispensed based on the response of the idle roller to the change in demand.

44. The apparatus of claim 39, wherein the control system is configured to identify a film break based on a speed of the idle roller.

45. The apparatus of claim 39, wherein the control system is further configured to:

compare an actual speed of the idle roller to an expected speed of the idle roller; and stop the rotational drive system if the actual speed differs from the expected speed by a selected amount.

46. The apparatus of claim 32, wherein the control system is configured to operate the dispensing drive and the rotational drive at a first ratio during a first portion of a wrapping cycle, and at a second ratio during a second portion of the wrapping cycle.

47. The apparatus of claim 46, wherein the control system is configured to operate the dispensing drive and the rotational drive at a third ratio during a third portion of the wrapping cycle, wherein at least one of the first, second, and third ratios is different from the others of the first, second, and third ratios.

48. The apparatus of claim 47, wherein the first portion is a start-up portion of the wrapping cycle, the second portion is a primary portion of the wrapping cycle, and the third portion is an end portion of the wrapping cycle.

49. A method of wrapping a load, comprising:

providing a film dispenser including at least one roller for dispensing a film web;

operating a rotational drive to provide relative rotation between the film dispenser and the load;

sensing a parameter related to demand for the film web at the load;

determining demand in response to the sensed parameter;

operating a film dispensing drive to drive the at least one roller of the film dispenser to dispense the film web; and electronically coupling the rotational drive to the film dispensing drive and proportionally controlling the drives to dispense a length of the film web based on demand for the film web at the load during at least a portion of a relative revolution between the film dispenser and the load.

50. The method of claim 49, wherein the demand is based, at least in part, on a girth of the load.

51. The method of claim 49, wherein electronically coupling includes simulating a connection between the rotational drive and the film dispensing drive.

52. The method of claim 51, wherein simulating a connection includes controlling the film dispensing drive with a first variable frequency drive.

53. The method of claim 52, wherein simulating a connection further includes controlling the rotational drive with a second variable frequency drive.

54. The method of claim 49, further comprising sensing a change in demand.

55. The method of claim 54, wherein sensing a change in demand includes:

sensing an actual speed of an idle roller positioned downstream of the film dispenser as the film is dispensed;

comparing the actual speed of the idle roller to an expected speed of the idle roller; and determining that the demand has changed when the actual speed does not equal the expected speed.

56. The method of claim 49, further comprising identifying the demand based at least in part on rotation of an idle roller positioned downstream of the film dispenser.

57. The method of claim 54, further comprising varying the length of the film web in response to the change in demand.

58. The method of claim 49, further comprising sensing a film break during the wrapping cycle.

59. The method of claim 58, wherein sensing a film break includes:

sensing an actual speed of an idle roller as the film is dispensed;

comparing the actual speed of the idle roller to an expected speed of the idle roller; and determining that the film has broken when the actual speed differs from the expected speed by a threshold amount.

60. The method of claim 58, further comprising automatically stopping film dispensing upon sensing a film break.

61. The method of claim 49, further comprising automatically adjusting the length of the film web in response to a change in demand produced by a change in a length of a portion of the load being wrapped.

62. The method of claim 61, wherein automatically adjusting includes:

sensing a surface speed of the dispensed film downstream of the film dispenser;

comparing the surface speed of the dispensed film to an expected speed of the dispensed film; and adjusting the length of the film in response to the change in load length signaled by a difference between the surface speed and the expected speed.

63. The method of claim 62, wherein adjusting the length includes increasing the length when the surface speed is greater than the expected speed.

64. The method of claim 62, wherein adjusting the length includes decreasing the length when the surface speed is less than the expected speed.

65. The method of claim 49, further comprising calculating a number of loads to be wrapped from an existing roll of film before a film roll change is necessary.

66. The method of claim 65, wherein calculating a number of loads to be wrapped includes:

monitoring rotation of a film dispensing roller of the film dispenser as the film is dispensed;

calculating, based on the rotation of the film dispensing roller, an amount of film remaining on the film roll; and determining a number of loads that can be wrapped with the amount of film remaining on the film roll.

67. The method of claim 58, wherein sensing a film break includes:

monitoring a direction of rotation of the idle roller; and determining that the film has broken when the direction of rotation of the idle roller reverses.

68. An apparatus for wrapping a load, comprising:

a film dispenser for dispensing a film web, wherein the film dispenser is driven by a film dispensing drive configured to rotate at least one film dispenser roller of the film dispenser;

a rotational drive system for providing relative rotation between the load and the dispenser;

a sensor sensing a parameter related to demand for the film web at the load; and a controller determining demand in response to the sensed parameter and mimicking a mechanical link between the film dispensing drive and the rotational drive system, wherein the controller further operates the dispensing drive and the rotational drive system at a first ratio during a first portion of a wrapping cycle, and at a second ratio during a second portion of the wrapping cycle, and at least one of the first ratio or the second ratio is configured to provide dispensing of the film web based at least in part on the determined demand for the film web at the load.

69. The apparatus of claim 68, wherein the controller is further configured to operate the dispensing drive and the rotational drive system at a third ratio during a third portion of the wrapping cycle, wherein at least one of the first, second, and third ratios is different from the others of the first, second, and third ratios.

70. The apparatus of claim 68, wherein the first portion is a start-up portion of the wrapping cycle, the second portion is a primary portion of the wrapping cycle, and the third portion is an end portion of the wrapping cycle.

71. The apparatus of claim 68, wherein the controller is configured to mimic the mechanical link by controlling the operation of one of the film dispensing drive and the rotational drive system based on the operation of the other of the film dispensing drive and the rotational drive system.

72. The apparatus of claim 68, wherein the controller is configured to operate the film dispensing drive and the rotational drive system at the first ratio based at least in part on demand by instructing the film dispensing drive to dispense a length of packaging material substantially equivalent to a distance traveled by the film dispenser during the first portion.

73. The apparatus of claim 68, wherein the controller is configured to operate the film dispensing drive and the rotational drive system at the second ratio based at least in part on demand by instructing the film dispensing drive to dispense a length of packaging material based on load girth and a desired percent of load girth dispensed for a revolution of the film dispenser relative to the load.

74. The apparatus of claim 69, wherein the controller is configured to operate the film dispensing drive and the rotational drive system at the third ratio by instructing the film dispensing drive to dispense film at a rate so that a selected payout is achieved, wherein the selected payout is selected to reduce forces acting on the film during the third portion of the wrapping cycle.

75. An apparatus for wrapping a load, comprising:

a film dispenser for dispensing a film web, wherein the film dispenser is driven by a film dispensing drive configured to rotate at least one film dispenser roller of the film dispenser;

a rotational drive system providing relative rotation between the load and the dispenser;

a sensor comprising an idle roller positioned downstream of the film dispenser, and a device detecting rotation of the idle roller about its longitudinal axis; and a controller controlling at least one of the film dispensing drive or the rotational drive system to dispense a length of film web based at least in part on information related to the sensor and at least one of the film dispensing drive or the rotational drive system.

76. The apparatus of claim 75, wherein the information related to the sensor corresponds to a length of the load traversed by the film dispenser during the at least a portion of a relative revolution.

77. The apparatus of claim 76, wherein the at least a portion of a relative revolution includes a full relative revolution, and the information related to the sensor corresponds, at least in part, to a girth of the load.

78. The apparatus of claim 75, further comprising a first variable frequency drive for controlling the film dispensing drive.

79. The apparatus of claim 78, further comprising a second variable frequency drive for controlling the rotational drive system.

80. The apparatus of claim 75, wherein the controller identifies demand for the film web based, at least in part, on rotation of the idle roller about its longitudinal axis.

81. The apparatus of claim 75, wherein the sensor responds to a change in demand.

82. The apparatus of claim 81, wherein the controller is configured to vary the length of the film web dispensed based on the response of the sensor to the change in demand.

83. The apparatus of claim 75, wherein the controller identifies a film break based on a speed or direction of rotation of the idle roller.

84. The apparatus of claim 75, wherein the controller operates the dispensing drive and the rotational drive system at a first ratio during a first portion of a wrapping cycle, and at a second ratio during a second portion of the wrapping cycle.

85. The apparatus of claim 84, wherein the controller operates the dispensing drive and the rotational drive system at a third ratio during a third portion of the wrapping cycle, wherein at least one of the first, second, or third ratios is different from the others of the first, second, or third ratios.

86. The apparatus of claim 85, wherein the first portion is a start-up portion of the wrapping cycle, the second portion is a primary portion of the wrapping cycle, and the third portion is an end portion of the wrapping cycle.

* * * * *